US009204703B2

(12) United States Patent
Farris

(10) Patent No.: US 9,204,703 B2
(45) Date of Patent: Dec. 8, 2015

(54) NAIL TRIMMER

(75) Inventor: Mark S. Farris, Ketchum, ID (US)

(73) Assignee: PERSCITUS INNOVATIONS LLC, Ketchum, ID (US)

( * ) Notice: Subject to any disclaimer, the term of this patent is extended or adjusted under 35 U.S.C. 154(b) by 1191 days.

(21) Appl. No.: 12/980,820

(22) Filed: Dec. 29, 2010

(65) Prior Publication Data

US 2011/0154667 A1 Jun. 30, 2011

Related U.S. Application Data

(60) Provisional application No. 61/291,356, filed on Dec. 30, 2009.

(51) Int. Cl.
*A45D 29/02* (2006.01)

(52) U.S. Cl.
CPC ..... *A45D 29/02* (2013.01)

(58) Field of Classification Search
CPC ..... A45D 29/02
USPC ..... 30/188, 24, 26, 27, 28, 29; 132/73.5–73.6, 76.2, 75.4, 75.5, 75.8
See application file for complete search history.

(56) References Cited

U.S. PATENT DOCUMENTS 741,709 A * 10/1903 Petrelli ..... 30/28
794,234 A 7/1905 La Casse
843,383 A 2/1907 Wooster
860,975 A 7/1907 Havell
967,598 A 8/1910 Bader
1,394,727 A 10/1921 Gronbech (Continued)

FOREIGN PATENT DOCUMENTS

FR 1563799 4/1969
JP S47-26024 A 7/1972

(Continued)

OTHER PUBLICATIONS

European Search Report in related European Patent application EP 10 19 7015, Applicant: Perscitus Innovations LLC, Inventor: Farris, May 6, 2011.

(Continued)

*Primary Examiner* — Ned Landrum
*Assistant Examiner* — Fernando Ayala
(74) *Attorney, Agent, or Firm* — Pedersen and Company, PLLC; Ken J. Pedersen; Barbara S. Pedersen

(57) ABSTRACT

A rear-pivot-point lever, cam-enabled, captured-spring-biased nail trimmer is disclosed. A base plate with a front cutting edge is pivotally connected to a top plate with a front cutting edge at a central base pivot point. A spring is captured between the plates in a manner that biases the front cutting edges of the trimmer apart until the trimmer is actuated. The top plate has a rear end for receiving and pivotally cooperating with a cammed actuating lever, the front end of which is pushed downward/forward to act against the bias of the spring to close the cutting edges to cut a nail. Because the lever arm pivots at a pivot point or axle at or near the rear end of the trimmer, the thumb and finger(s) of the user are positioned at or near the front of the trimmer during use, and therefore, near the nail being trimmed. This results in stable and non-twisting operation. The lever may be swung around the plates of the trimmer to rest below the bottom plate in a compact configuration.

21 Claims, 27 Drawing Sheets

(56) References Cited

U.S. PATENT DOCUMENTS

| | | | | | |
|---|---|---|---|---|---|
| 1,555,973 | A | | 10/1925 | Hoge | |
| 1,958,300 | A | * | 5/1934 | Flack | 30/212 |
| 2,570,025 | A | * | 10/1951 | Davis | 30/28 |
| 2,616,436 | A | | 11/1952 | Langley | |
| 3,180,025 | A | * | 4/1965 | Tsunemi | 30/28 |
| 3,744,131 | A | * | 7/1973 | Manes | 30/28 |
| 5,392,518 | A | | 2/1995 | Means | |
| 5,617,633 | A | | 4/1997 | Lee | |
| D439,375 | S | | 3/2001 | Socarras | |
| D446,886 | S | | 8/2001 | Park | |
| D466,251 | S | | 11/2002 | Park | |
| D468,865 | S | | 1/2003 | Park | |
| 6,557,259 | B1 | | 5/2003 | Nguyen | |
| 6,705,014 | B2 | | 3/2004 | Park | |
| 6,735,869 | B2 | * | 5/2004 | Lau | 30/28 |
| D497,221 | S | | 10/2004 | Yeung | |
| D507,077 | S | * | 7/2005 | Kearson et al. | D28/60 |
| 7,234,238 | B2 | | 6/2007 | Wong | |
| D551,802 | S | | 9/2007 | Rubin et al. | |
| D594,156 | S | | 6/2009 | Kita | |
| 2004/0205968 | A1 | | 10/2004 | Choi | |
| 2008/0168656 | A1 | * | 7/2008 | Cho | 30/28 |
| 2009/0211098 | A1 | * | 8/2009 | Childs, II | 30/28 |
| 2013/0212884 | A1 | * | 8/2013 | Doane | 30/28 |

FOREIGN PATENT DOCUMENTS

| | | | |
|---|---|---|---|
| JP | S53-77400 | A | 7/1978 |
| JP | S60-190568 | A | 12/1985 |
| JP | H2-71406 | A | 5/1990 |
| JP | H5-329022 | A | 12/1993 |

OTHER PUBLICATIONS

Japanese Examiner's Action in related Japanese Patent Application JP 2010-291,747, Applicant: Perscitus Innovations LLC, Inventor: Farris, Mar. 3, 2015.

* cited by examiner

NAIL TRIMMER

This application claims priority benefit of U.S. Provisional Application Ser. No. 61/291,356, filed Dec. 30, 2009, the disclosure of which is incorporated herein by this reference.

BACKGROUND OF THE INVENTION

1. Field of the Invention

This invention relates generally to nail trimmers. More specifically, this invention relates to an off-set lever, cam-enabled, captured-spring-biased nail trimmer.

2. Related Art

There are many nail trimmer designs in the prior art. Still, there is an absence of fresh nail trimmer designs that may excite the visual and mechanical interests of modern buyers. This invention addresses this need.

SUMMARY OF THE INVENTION

The present invention is an rear-pivot-point lever, cam-enabled, captured-spring-biased nail trimmer. The trimmer comprises a base plate with a front cutting end, a central base pivot point for receiving a top plate also having a front cutting end, and a spring for biasing the base plate and top plate into an open, non-cutting position. The top plate also has a central top pivot point for cooperating with the central base pivot point of the base plate, preferably with an axle connecting the base and top plates at said central base pivot points. In addition, the top plate also has a rear end for receiving and pivotally cooperating with a cammed actuating lever. The lower cammed surface of the actuating lever also cooperates with a top surface of the base plate so that, when the actuating lever is pressed downward and forward, for example by pivoting the lever toward the top plate, the front end of the top plate is urged downward onto the front end of the base plate to perform the nail trimming operation.

In the preferred embodiment, the base plate—has a longitudinal spring secured to near its rear end. The spring curves from near the back end of the base plate to almost near its front end. There, the curved spring passes over a pivot axle connecting the base plate and the top plate at their central pivot point, and rests under the bottom surface of the top plate near its front end. The bias of the spring biases the front ends of the trimmer open, because the spring is biased to straighten and pulls the back end of the base plate upward relative to the rear end of the top plate. This bias may be overcome by the pressure of the actuating lever when it is actuated to close the trimmer front ends. Alternatively, the nail trimmer may use other types and styles of spring(s), for example, a flat leaf spring positioned similarly to the springs in the drawings of this document, or a coil spring at or near the back ends of the plates for urging the back ends together to separate the front cutting edges of the plates.

The actuating lever may be located in various locations relative to the plates with cutting edges. For example, the actuating lever may be offset to be on or near the right side or the left side, or, may be located centrally along the longitudinal center plane of the trimmer.

DETAILED DESCRIPTION OF THE PREFERRED EMBODIMENTS OF THE INVENTION

Figure 16:
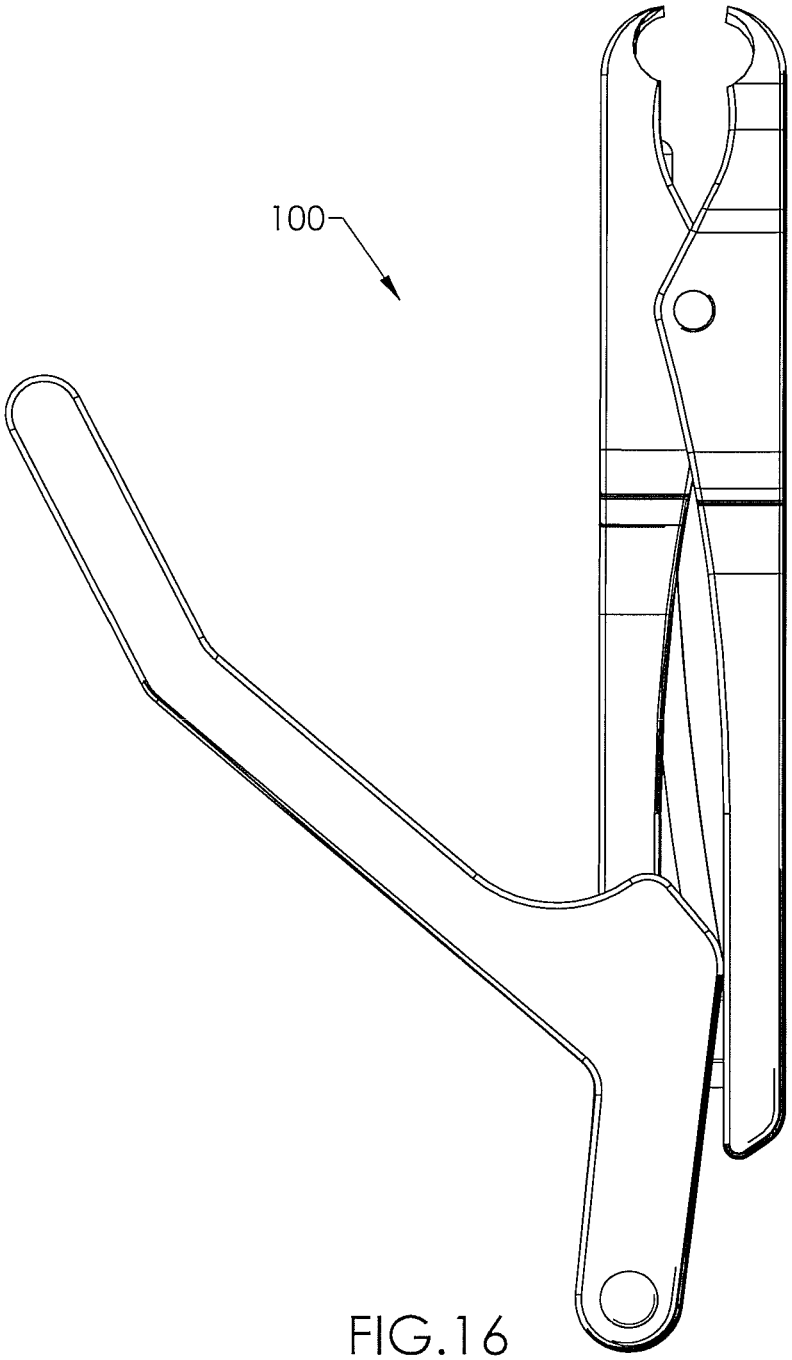
FIG. 16 is a right side view of an alternative embodiment of the invented nail trimmer that has more rounded edges.
Figure 17:
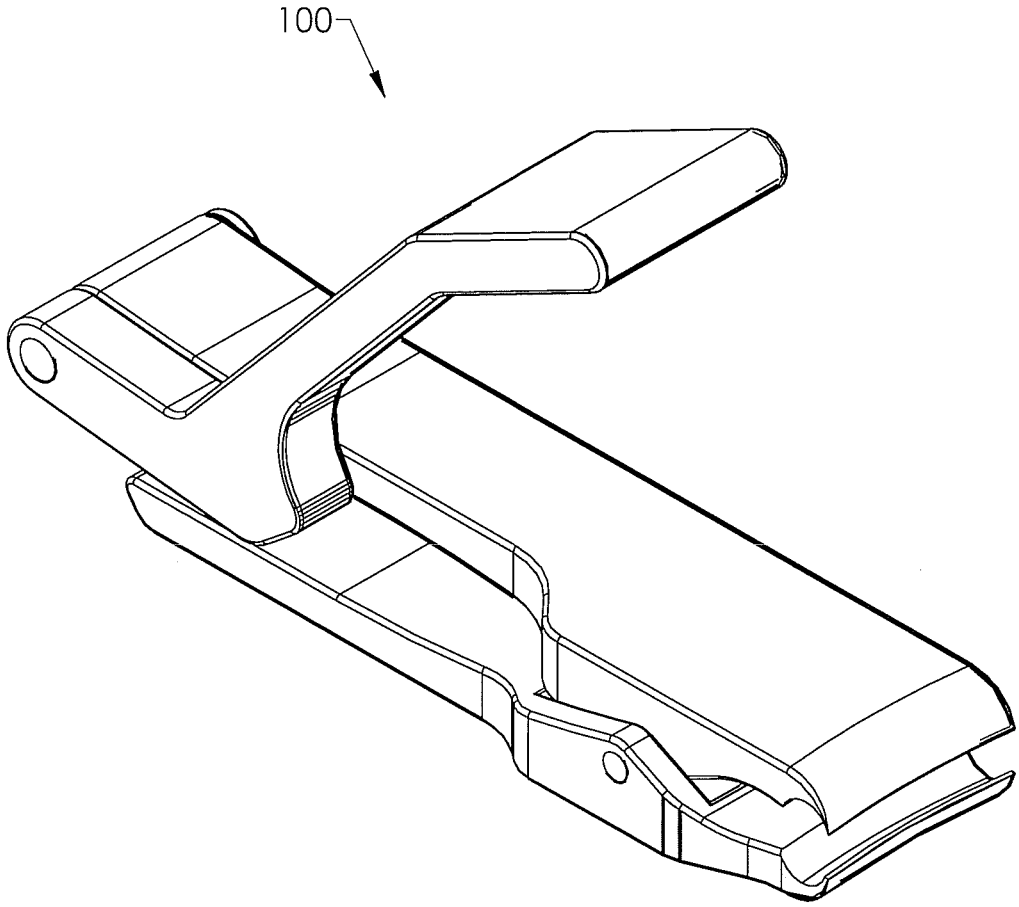
FIG. 17 is a right top perspective view of the nail trimmer of FIG. 16, with the trimmer in the open, ready-for-use position.
Figure 18:
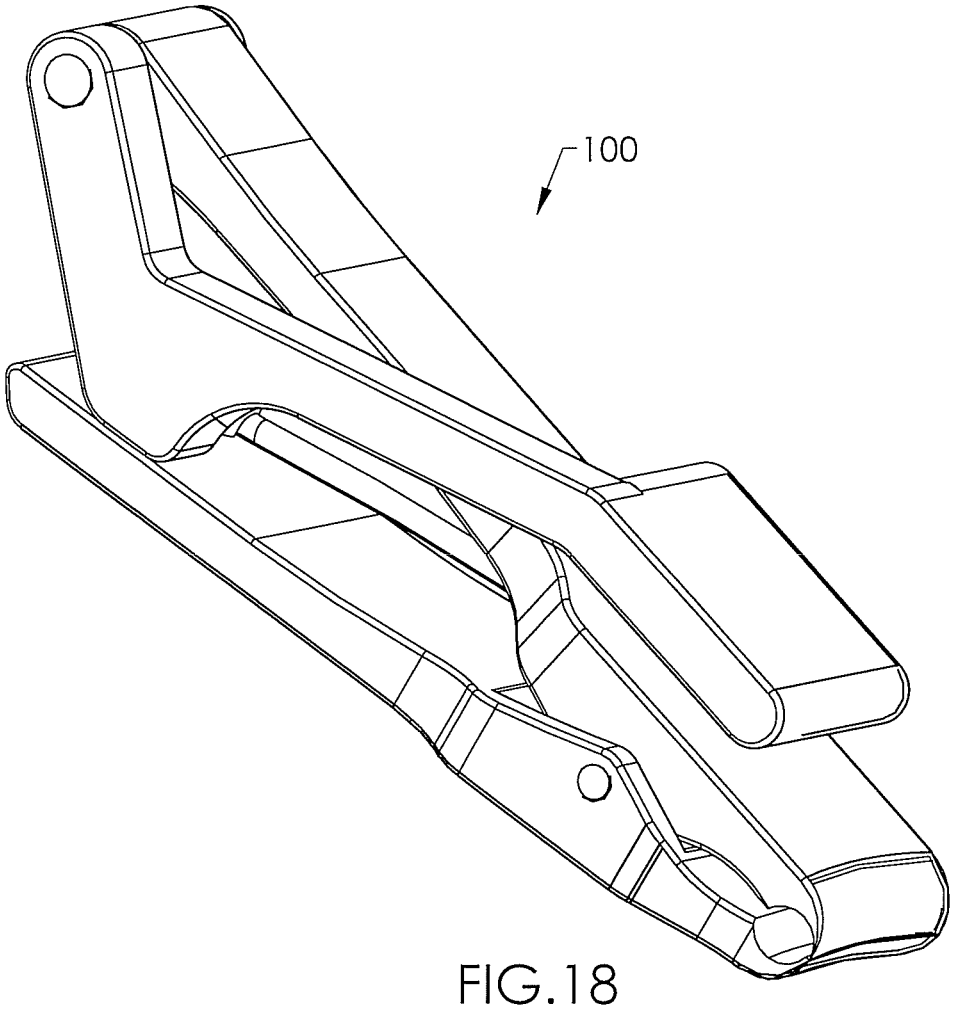
FIG. 18 is a right top perspective view of the nail trimmer of FIGS. 16 and 17, with the trimmer in the closed, cutting position.

Referring to the figures, there are shown several, but not the only, embodiments of the invented device. Nail trimmer 10 is depicted in FIGS. 1-15, Nail trimmer 100 is depicted in FIGS. 16-18, and nail trimmer 200 is depicted in FIGS. 19-33.

Figure 1:
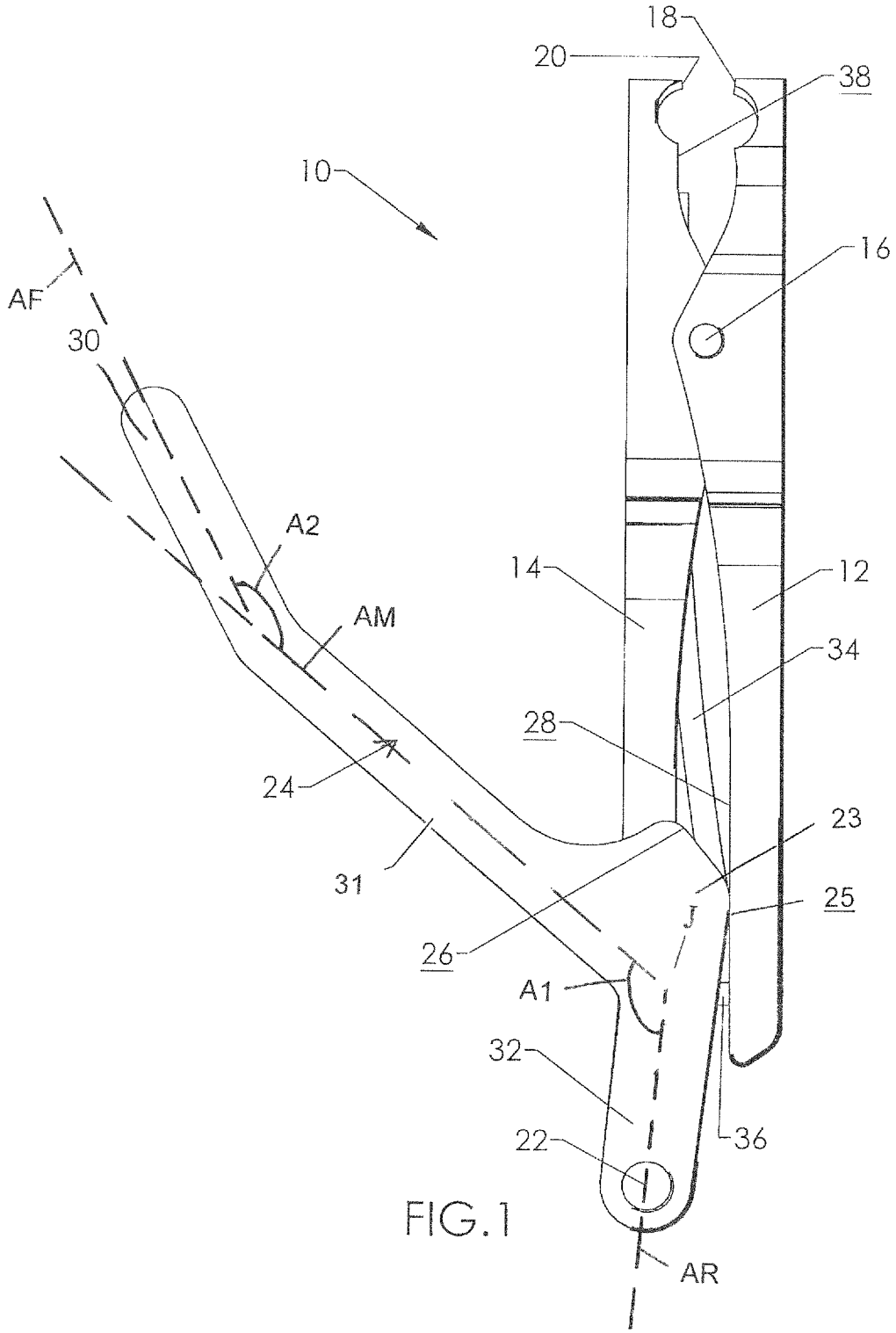
FIG. 1 is a first, right-side view of one embodiment of the present invention in opened position, but with the cam lever engaged and ready to be activated.

Nail trimmer 10 is shown in opened position in FIG. 1. Trimmer 10 has base plate 12 connected to top plate 14 by plate pivot axle 16. Base plate 12 and top plate 14 have front cutting edges 18 and 20, respectively.

Near the back end of the top plate 14 is lever pivot axle 22 which connects actuating lever 24 to top plate 14. As shown in FIG. 1, lever 24 includes an elongated rear portion (lever back 32) having a longitudinal axis AR, an elongated front tip portion (lever tip 30) having a longitudinal axis AF, and an elongated middle portion 31 having a longitudinal axis AM and being between said rear portion and said front tip portion and connected to the rear portion at a junction J. As shown in FIG. 1, the middle portion longitudinal axis AM is at an obtuse angle A1 to the rear portion longitudinal axis AR, and the front tip portion longitudinal axis AF is at an obtuse angle A2 to the middle longitudinal axis AM. Lever 24 has a cammed surface 26 which contacts and cooperates with top surface 28 of base plate 12 when lever tip 30 is pushed forward and down to lift lever back 32 up and urge the front cutting edge 20 of top plate 14 down toward the front cutting edge 18 of base plate 12. Longitudinal spring 34 is secured to near the back end of base plate 12 with clamp 36. Spring 34 extends from near the back end of base plate 12, passes over plate pivot axle 16, and rests under the bottom surface 38 of top plate 14 near its front. This way, spring 34 urges the rear ends of base plate 12 and top plate 14 together, and urges the base plate 12 and top plate apart at their front cutting edges 18 and 20, respectively. One may note that the spring 34 and clamp 36 of trimmer 100 are preferably offset to one side of the trimmer, as shown to best advantage in FIGS. 8, 9, and 15. Alternatively, clamp structure for capturing/holding the spring may be integral with the base plate 12, rather than being screwed to the base plate. For example, there may be an opening in the base plate and/or an opening in a protrusion upending from the base plate that will capture a rear end of the spring. The longitudinal spring may have a hook or other non-linear structure, for example, to hook into and/or otherwise be retained in said clamp structure. The spring may also have curvature and/or bends to better extend through the trimmer body to near the front end of the trimmer. Therefore, the longitudinal spring need not be perfectly straight or linear, but may have some curvature and/or bends even when removed from the nail trimmer and consequently not under any external force.

While trimmer 10 comprises a lever that is located generally on the right side of the trimmer, and on the right side of the top plate, it will be understood that the lever may be positioned on the left of the trimmer and the top plate. The trimmer may be a mirror image of the trimmer 10 shown in FIGS. 1-15, or of the trimmer 100 shown in FIGS. 16-18. In other words, the lever is located to one side or the other of a longitudinal center plane, wherein said center plane extends into the paper of FIG. 3 midway between the sides of the trimmer.

Most of the components of nail trimmer 10 discussed above are also visible in FIG. 2, which is a left side view of the nail trimmer 10 shown in the right side view of FIG. 1.

Figure 2:
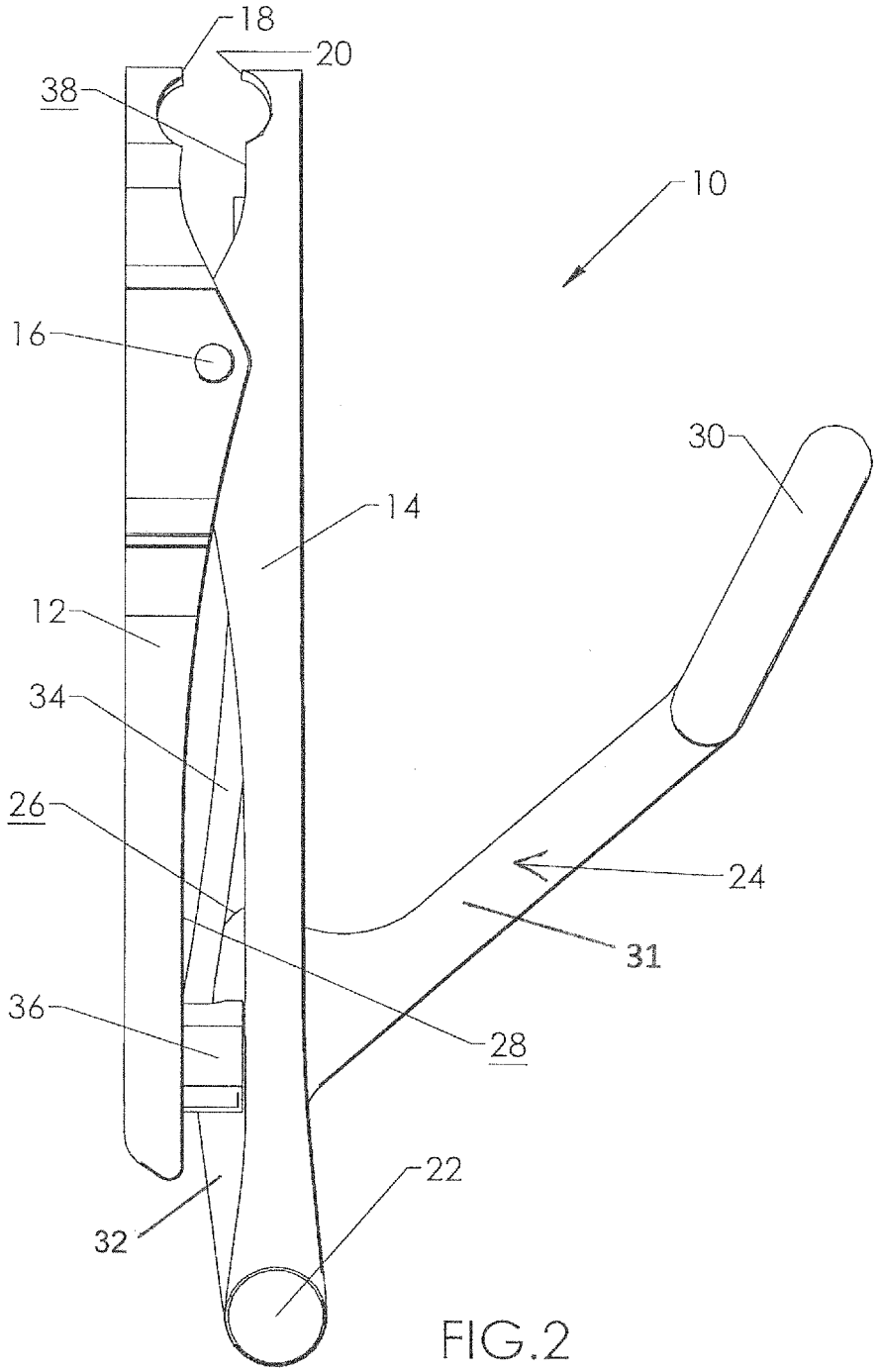
FIG. 2 is a second, left-side view of the embodiment depicted in FIG. 1.
Figure 3:
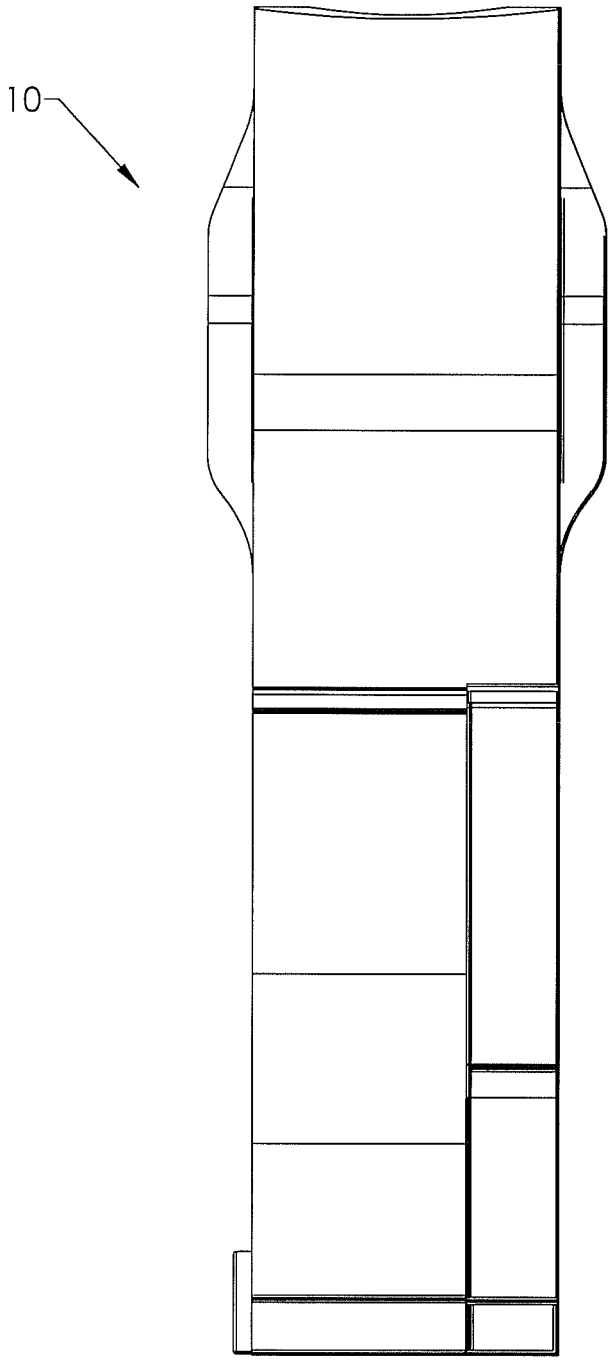
FIG. 3 is a top view of the embodiment depicted in FIGS. 1 and 2.
Figure 4:
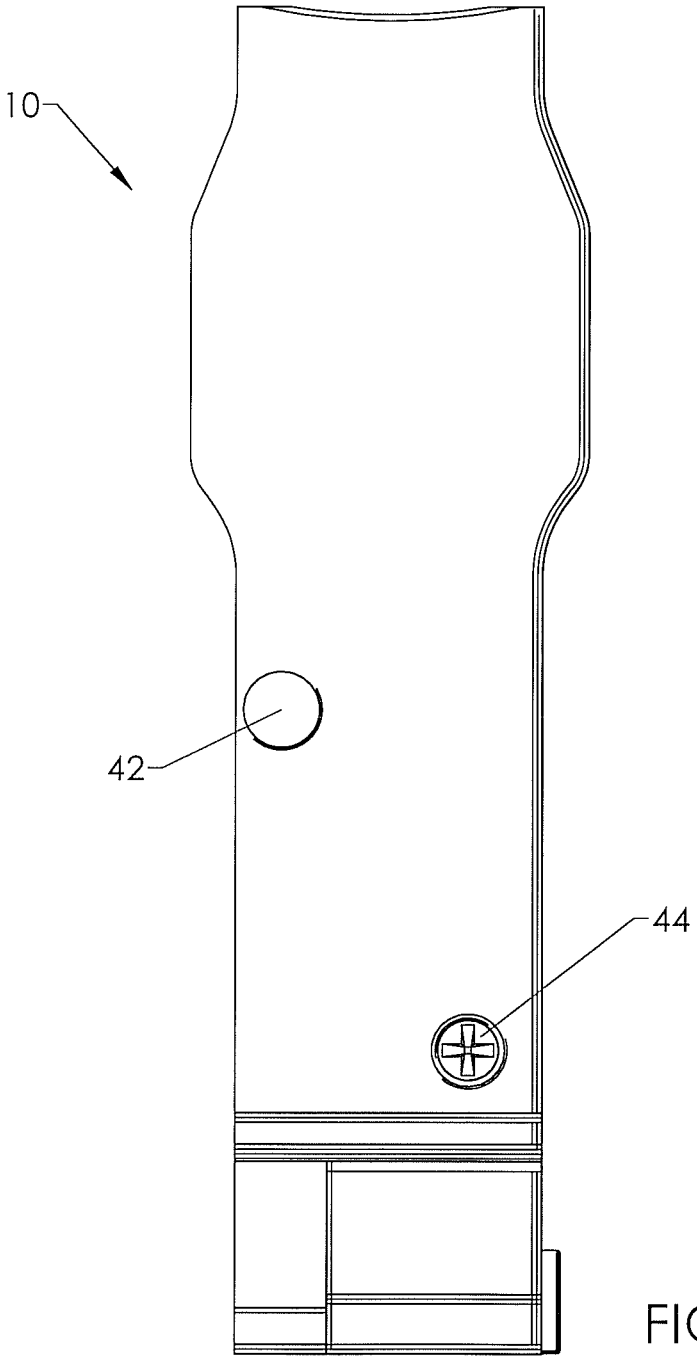
FIG. 4 is a bottom view of the embodiment depicted in FIGS. 1 and 2.
Figure 5:
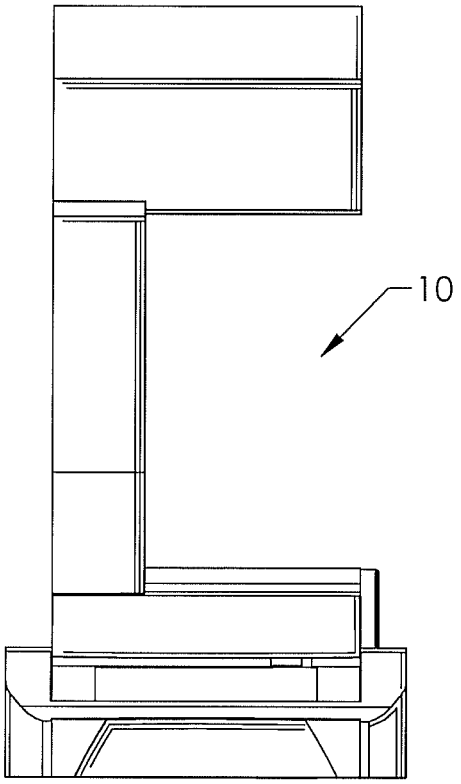
FIG. 5 is a front view of the embodiment depicted in FIGS. 1 and 2.
Figure 6:
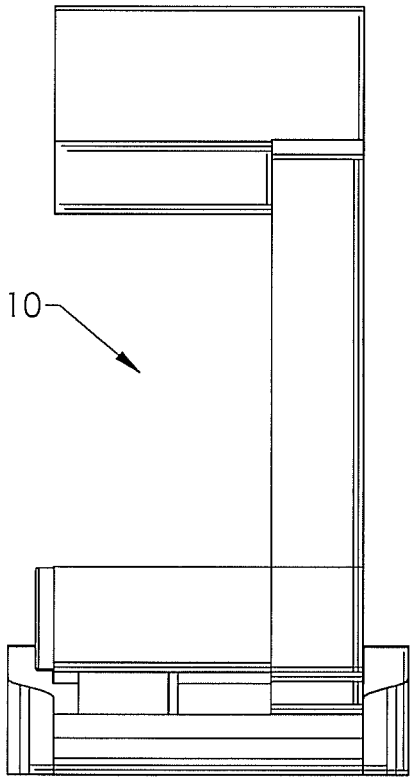
FIG. 6 is a back view of the embodiment depicted in FIGS. 1 and 2.
Figure 7:
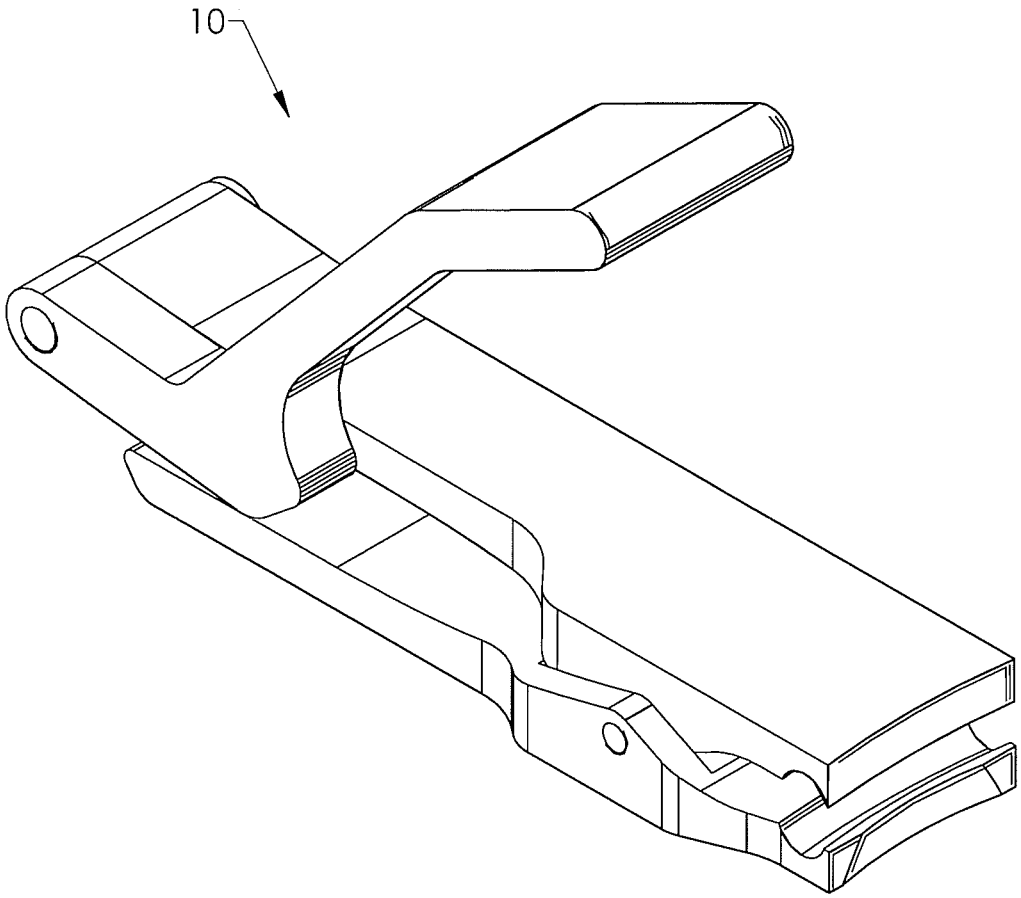
FIG. 7 is a top, right-side perspective view of the embodiment depicted in FIGS. 1 and 2, with the clipper in open position, ready for use.

FIGS. 3, 4, 5, 6, and 7 depict different views of the embodiment depicted in FIGS. 1 and 2. Specifically, FIG. 3 is a top view, FIG. 4 is a bottom view, FIG. 5 is a front view, and FIG. 6 is a back view of nail trimmer 10. FIG. 7 is a top, right-side perspective view of trimmer 10, with the clipper in open position, ready for use.

Figure 8:
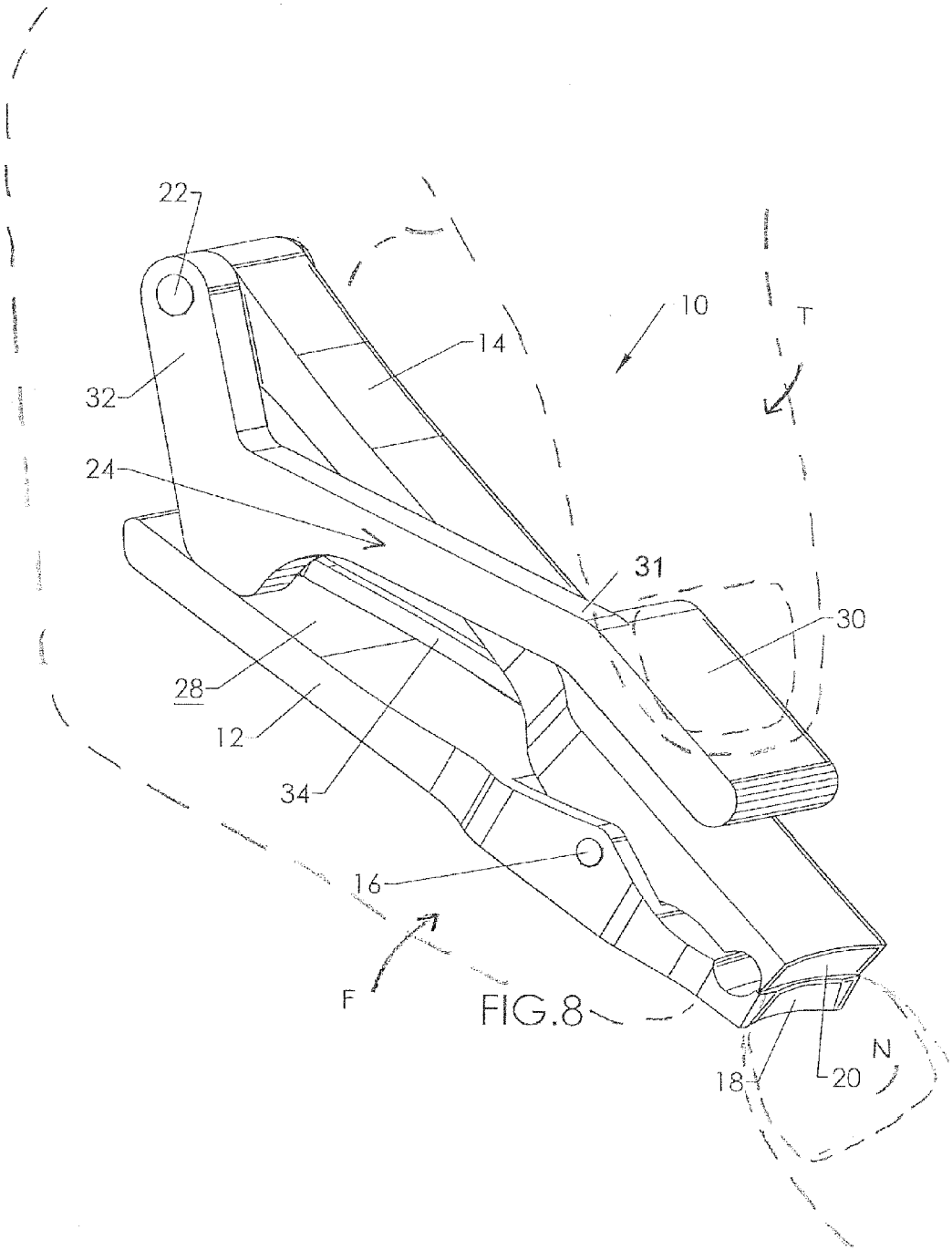
FIG. 8 is similar to the view depicted in FIG. 7, but with the trimmer in the closed position, with the cam lever not only engaged, but fully actuated to bring the sharp front ends of the base plates together for cutting of a nail.

FIG. 8 is a right top perspective view of the trimmer 10. In this figure, actuating lever tip 30 has been pushed down, which, because of the pivotal connection of the lever to the trimmer, amounts to pivoting of the tip 30 forward and downward. This motion raises lever back 32 up, and raising the back end of top plate 14. Because of the pivotal connection of the top plate 14 and base plate 12, this motion causes front cutting edge 20 of top plate 14 to be urged down towards front cutting edge 18 of base plate 12, enabling the nail trimming operation.

Figure 9:
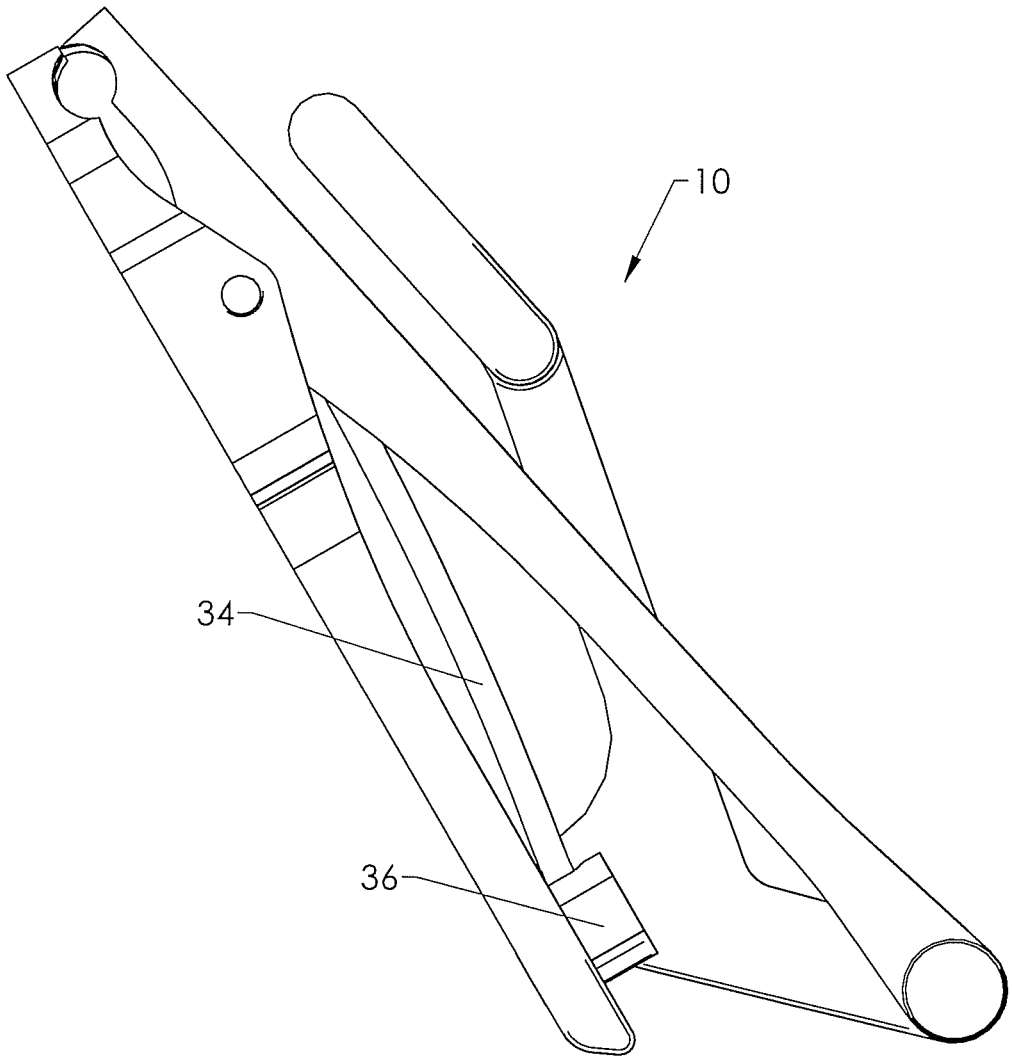
FIG. 9 is a left-side view of the embodiment depicted in FIG. 8.

FIG. 9 is a left side view trimmer 10, again in the closed configuration with cutting edges 18 and 20 together.

Figure 10:
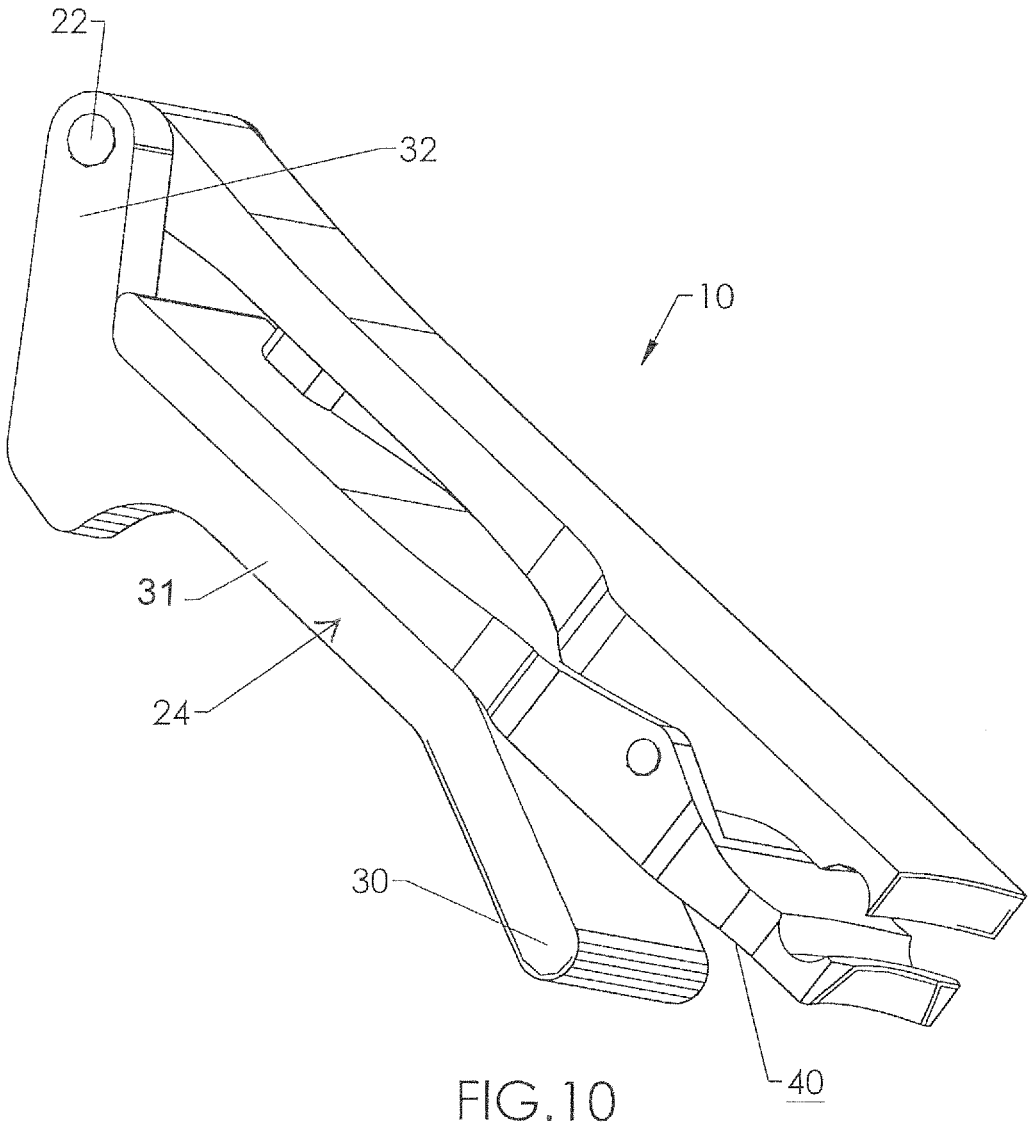
FIG. 10 is a top, right-side perspective view, but with the cam lever rotated away from the second base plate and against the lower surface of the first base plate, into the stored, compact, open position.

In FIG. 10, actuating lever 24 has been pushed back and rotated all the way around pivot axle 22 to reach and rest against the bottom surface 40 of base plate 12. Preferably, lever 24 is maintained in this stored position by magnet 42 which is visible in FIG. 4. In this position, the trimmer 10 is compact and conveniently stored.

Figure 11:
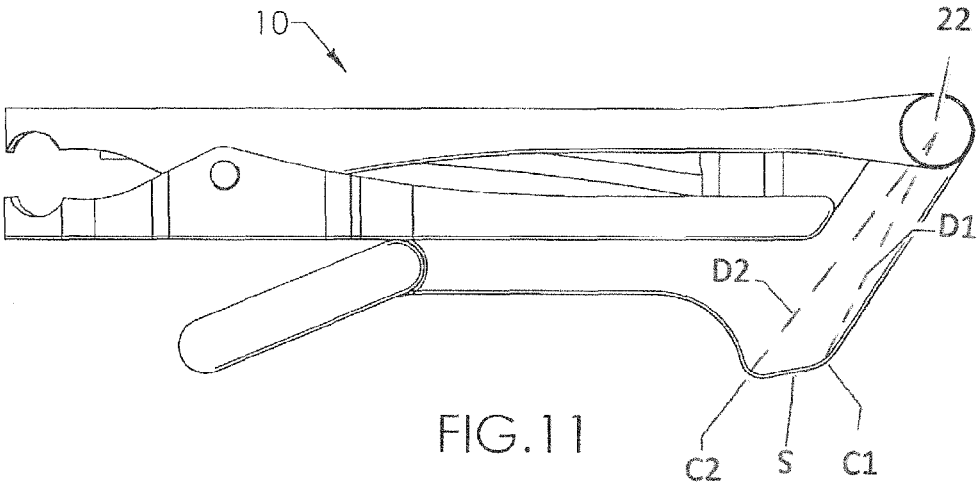
FIG. 11 is a left-side view of the embodiment of FIGS. 1-10, in the storage configuration of FIG. 10.
Figure 12:
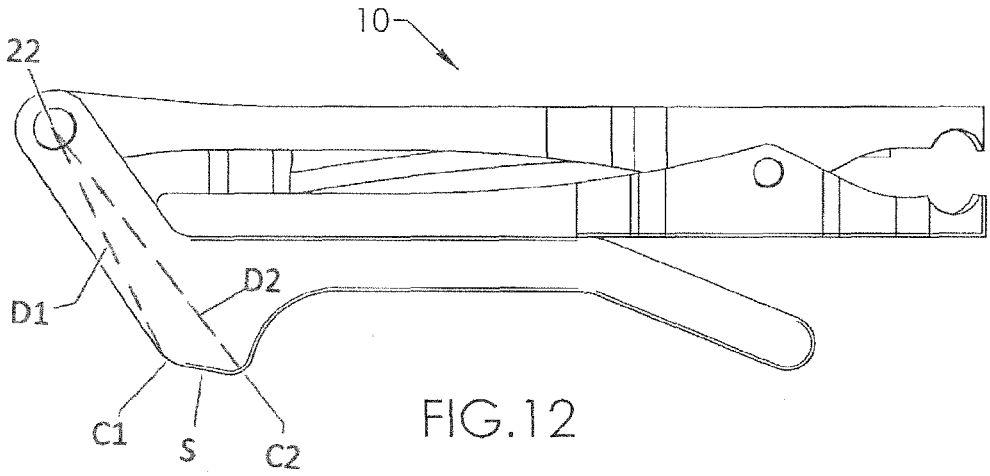
FIG. 12 is a right-side view of the embodiment of FIGS. 1-10, in the storage configuration of FIG. 10.

FIGS. 11 and 12 depict a left and a right view, respectively, of the nail trimmer 10 in the storage configuration of FIG. 10. FIGS. 11 and 12 show how, in the storage configuration, the rear portion (lever back 32) of the lever extends downward from the rear pivot point and behind the rear end of the bottom plate 12, the middle portion 31 is below, parallel to, and against the bottom surface of the bottom plate 12, and the front tip portion (lever tip 30) is below and adjacent to the bottom surface of the bottom plate 12. Also shown in FIGS. 11 and 12, the protruding cam 23 lower surface comprises a planar surface S between a rearward corner C1 and forward corner C2, wherein corner C2 is a distance D2 from the pivot axle 22 that is greater than that distance D1 of corner C1 from the pivot axle 22.

Figure 13:
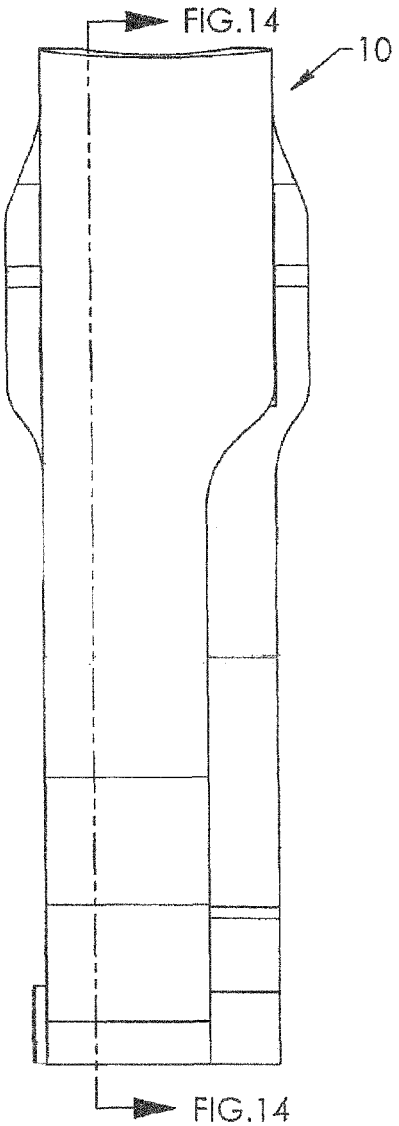
FIG. 13 is a top view of the embodiment of FIGS. 1-10, in the storage configuration of FIG. 10.
Figure 14:
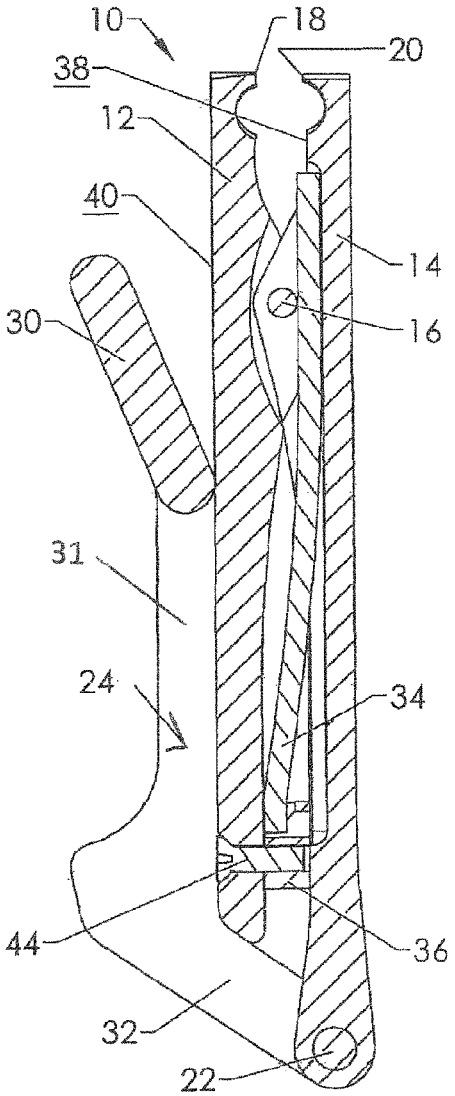
FIG. 14 is a partial cross-sectional view of the embodiment of FIGS. 1-10, in the storage configuration of FIG. 10, taken along line 14-14 in FIG. 13.

FIG. 13 is a top view of the nail trimmer 10, in its storage configuration as in FIGS. 10-12. FIG. 13 has an off-center longitudinal section line 14-14, along which the cross-section of FIG. 14 is viewed. In FIG. 14, a screw 44 for securing clamp 36 to base plate 12 is visible. This screw 44 is also visible in FIG. 4. Alternatively, as discussed earlier in this document, an integral clamp or other receiving structure or aperture may be provided on or in the base plate 12 to capture the rear end of the spring, including a hooked, curved, or looped end of the spring. Alternatively, other springs may be used, for example, a flat leaf spring positioned similarly to the springs shown in the drawings, or a coil spring pulling the back ends of the base plate and top plate together. For such alternative spring embodiments, clamps or retainers other than those shown may be used to capture the coil spring.

Figure 15:
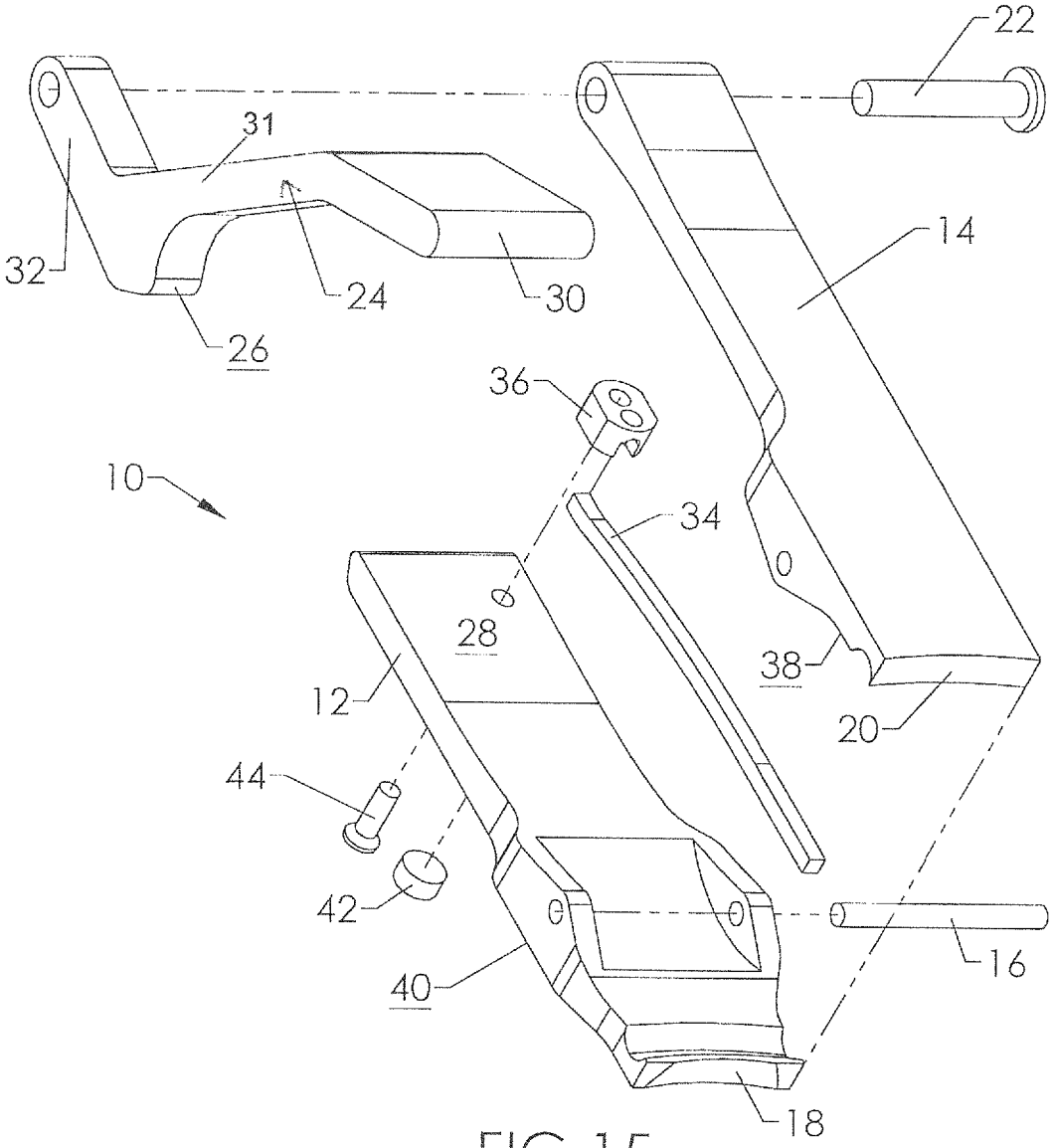
FIG. 15 is a right-side, top, exploded perspective view of the embodiment depicted in FIGS. 1-14.

FIG. 15 is an exploded, perspective view of the embodiment depicted in FIGS. 1-14, wherein the lever 24 is in an in-use orientation rather than the storage orientation.

The present invention may be manufactured from conventional materials by conventional methods. Metals that may be cast or otherwise formed to have sharp cutting edges are preferred. The front cutting edges 18 and 20 may be of conventional design. Preferably, longitudinal spring 34 may be made of spring steel, and, while it is shown as having a rectangular-cross-section, other spring shapes may be used, such as circular-cross-section longitudinal springs, or other springs such as a flat leaf spring or a coil spring.

FIGS. 16 and 17 illustrate a right side view and a right top perspective view of nail trimmer 100, which is very similar to trimmer 10 except that it features several rounded edges. FIGS. 16 and 17 both show trimmer 100 in its open, ready-for-cutting configuration. FIG. 18 is a right top perspective view of nail trimmer 100 in its closed, cutting configuration, with lever pivoted downward and cutting edges together.

Figure 19:
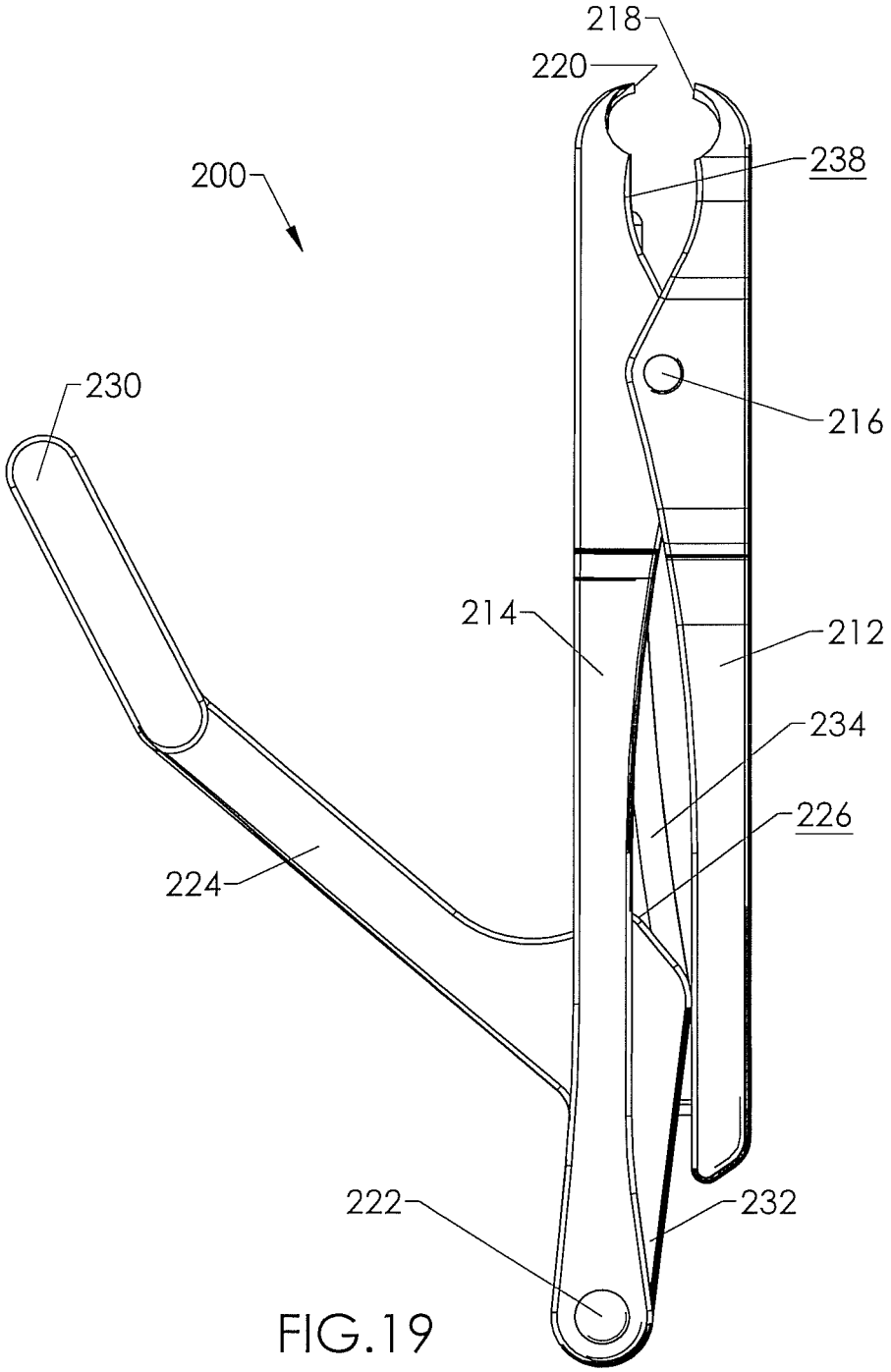
FIG. 19 is a right side view of yet another embodiment of the invented nail trimmer, which has a centrally-located lever for actuating the trimmer.

FIGS. 19-33 illustrate an alternative embodiment of the invented nail trimmer that has a lever that is located and pivots in a more central location relative to the base plate and top plate, rather than a lever that is off to one side or the other of the top plate. FIG. 19 is a right side view of trimmer 200, similar to the right side view of trimmer 10 in FIG. 1. Trimmer 200 has base plate 212 connected to top plate 214 by plate pivot axle 216. Base plate 212 and top plate 214 have front cutting edges 218 and 220, respectively.

Near the back end of the top plate 214 is lever pivot axle 222 which connects actuating lever 224 to top plate 214. Lever 24 has a cammed surface 226 which contacts and cooperates with top surface of base plate 212 when lever tip 230 is pushed/pivoted down and forward to lift lever back 232 up and urge the front cutting edge 220 of top plate 214 down toward the front cutting edge 218 of base plate 212. Longitudinal spring 234 is secured to near the back end of base plate 212 with clamp 236. Spring 234 extends from near the back end of base plate 212, passes over plate pivot axle 216, and rests under the bottom surface 238 of top plate 214 near its front. This way, spring 234 urges the rear ends of base plate 212 and top plate 214 together, and urges the base plate 212 and top plate apart at their front cutting edges 218 and 220, respectively. Note that the spring 234 and clamp 236 are located to one side of the central longitudinal axis of the trimmer, so as to be offset to one side of and not interfering with the lever 224. This may be seen to best advantage in FIGS. 26, 27 and 33. Alternatively, as disclosed earlier in this document, an integral clamp or other receiving structure or aperture may be provided on or in the base plate 12 to capture the rear end of the spring, including to capture a hooked, curved, or looped end of the spring. Alternatively, other springs may be used, for example, a flat leaf spring positioned similarly to the springs shown herein, or a coil spring pulling the back ends of the base plate and top plate together. In such alternative embodiments, clamps or retainers others than those shown may be used to capture the coil spring.

Figure 25:
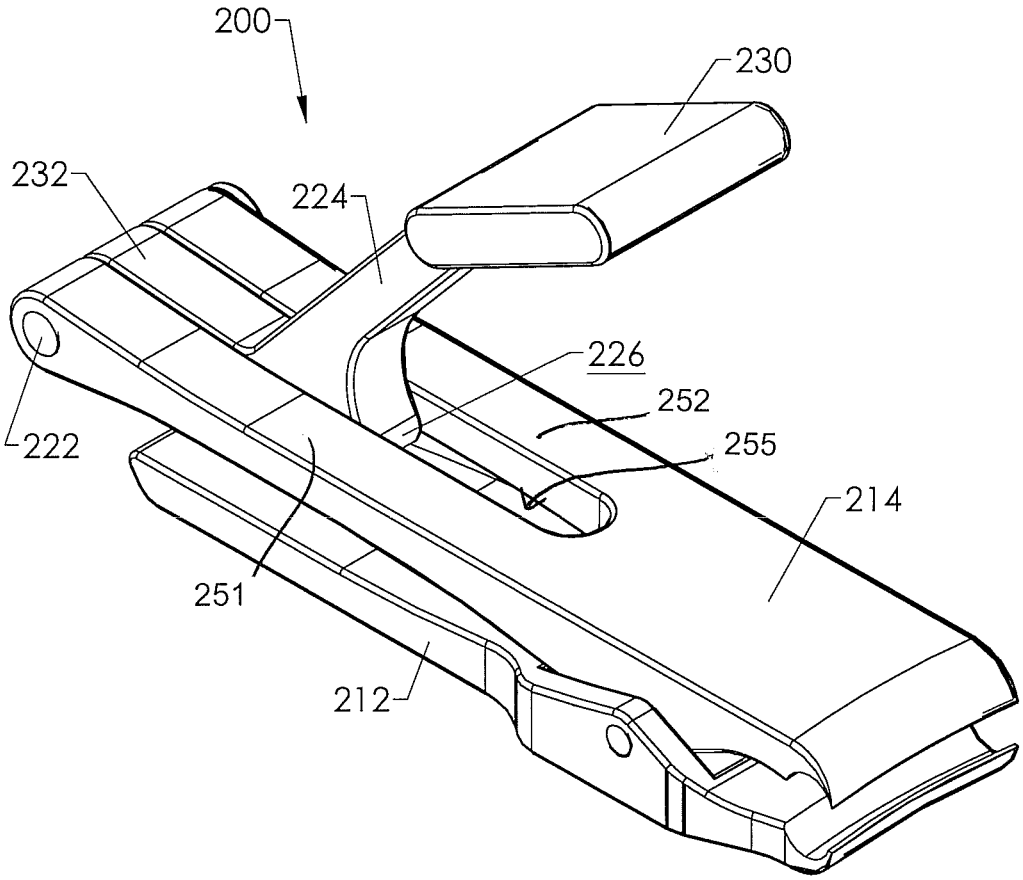
FIG. 25 is a right top perspective view of the embodiment of FIGS. 19-24 in the open, ready-for-use position.

The major difference between trimmer 200 and trimmers 10 and 100 is the location of the lever 224 relative to base plate 212 and top plate 214. Lever 224 is located and pivotally connected to the top plate 214 in a central location, which is between a right arm 251 and a left arm 252 of the back end of the top plate. The right and left arms 251, 252 are parallel extensions that extend parallel to the longitudinal axis of the trimmer. Central space 255 is between the arms 251, 252 and receives lever 224 and provides space for the lever 224 to pivot down and forward toward the front end of the top plate 214. This lever location and operation is best illustrated in FIG. 25 (open configuration) and FIG. 26 (closed, cutting configuration). This trimmer 200 is easily held and used, with force exerted on the lever 224 being applied in a plane generally extending through the central, longitudinal axis of the trimmer 200, rather than to one or the other side of the longitudinal axis of the trimmer 200. The central location of the lever may prevent twisting of the trimmer during use, as the force will be applied nearly straight down along the central longitudinal plane. With finger(s) against the bottom surface of the base plate 212 and a thumb or finger against the top surface of the lever tip 230, the finger(s) and thumb are close to the nail being trimmed and are holding and forcing the trimmer parts in a balanced, stable, non-twisting manner. This trimmer 200 may also appeal equally to both right- and left-handed users.

Nail trimmer 200 may be manufactured from conventional materials by conventional methods. Metals that may be cast or otherwise formed to have sharp cutting edges are preferred. The front cutting edges 218 and 220 may be of conventional design. Preferably, longitudinal spring 234 may be made of spring steel, and, while it is shown as having a circular-cross-section, other longitudinal spring shapes and other spring types of springs may be used.

Figure 20:
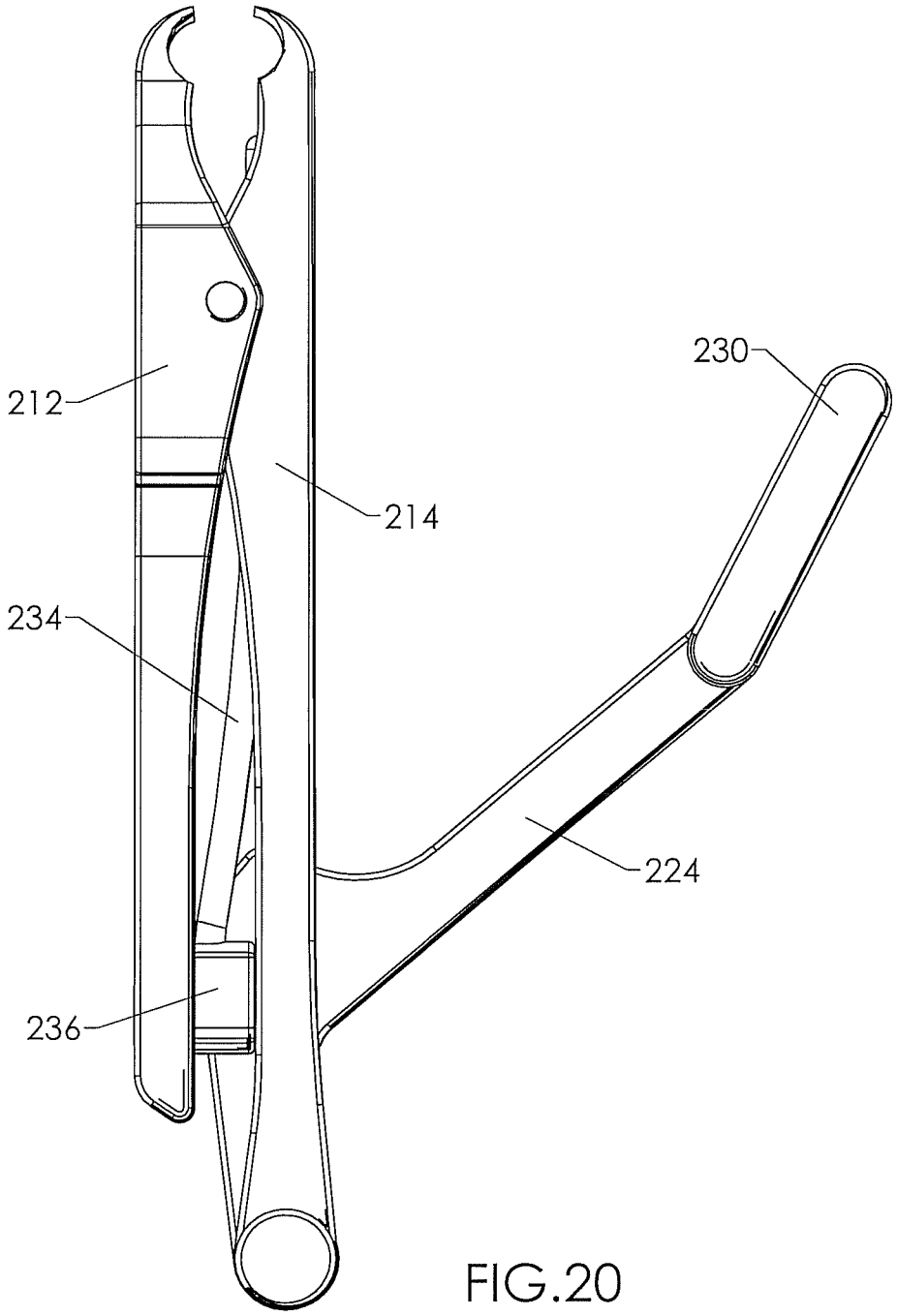
FIG. 20 is a left side view of the embodiment of FIG. 19.
Figure 21:
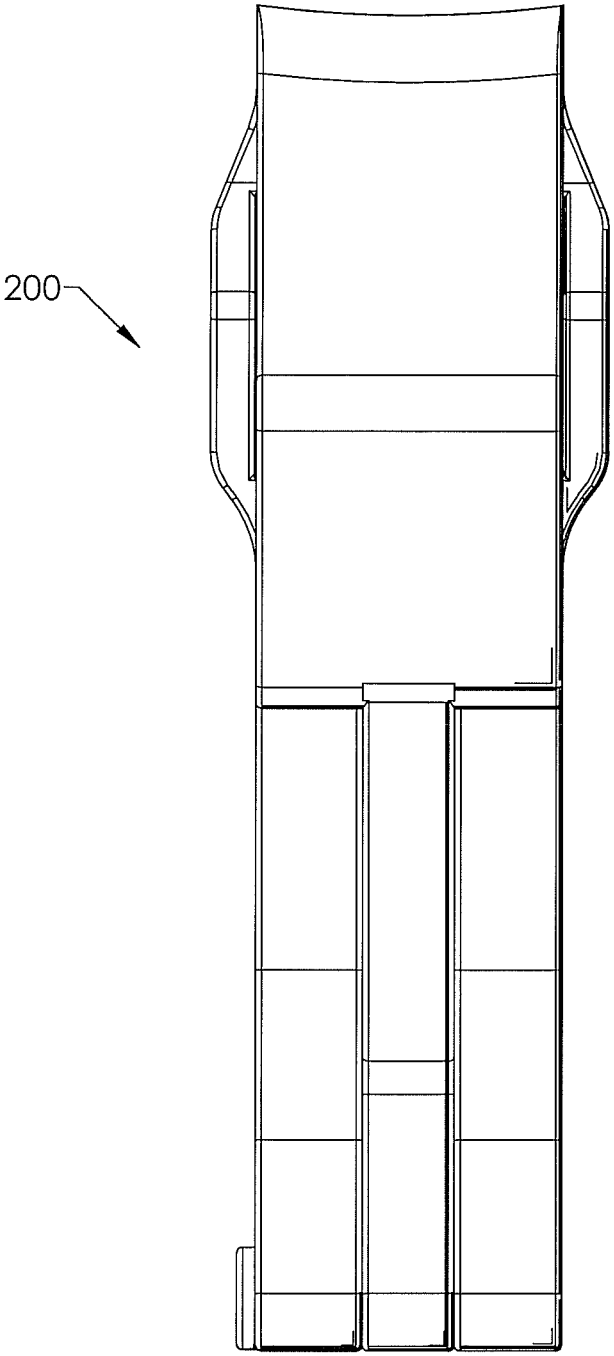
FIG. 21 is a top view of the embodiment of FIGS. 19 and 20.
Figure 22:
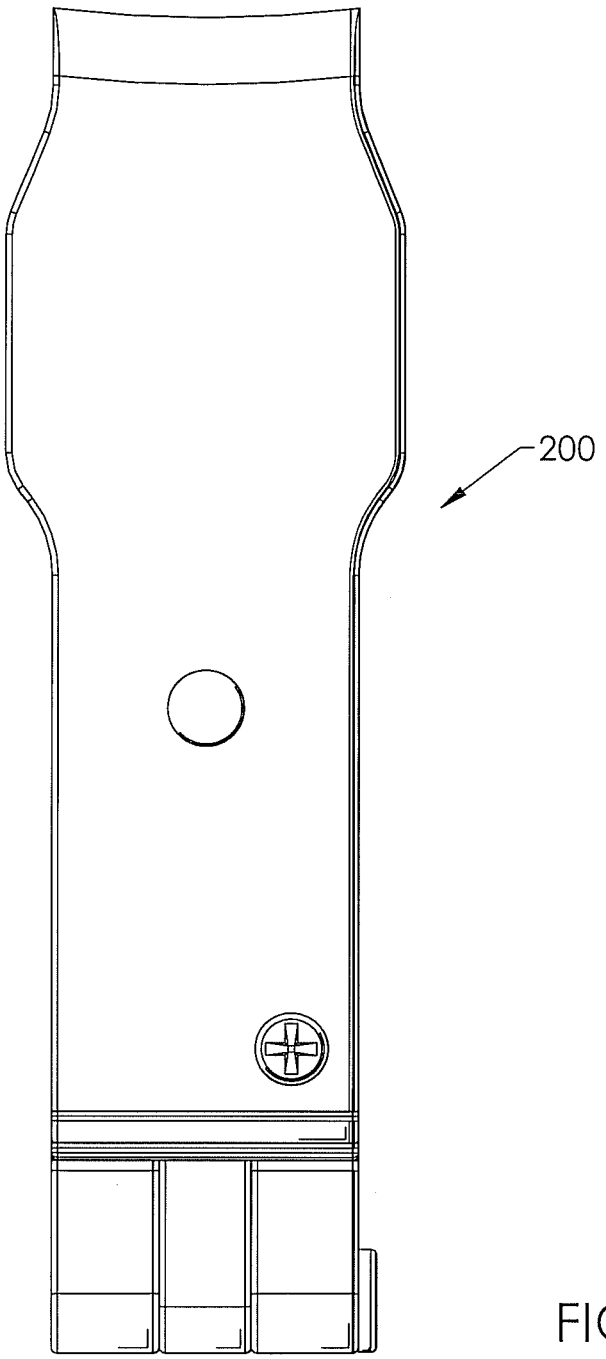
FIG. 22 is a bottom view of the embodiment of FIGS. 19-21.
Figure 23:
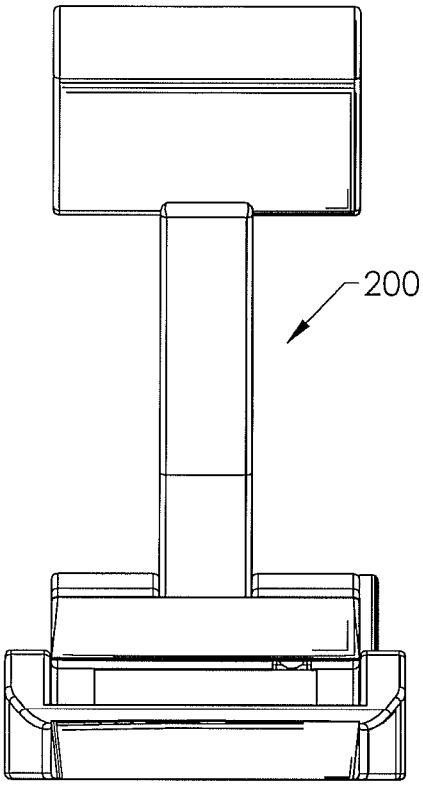
FIG. 23 is a front view of the embodiment of FIGS. 19-22.
Figure 24:
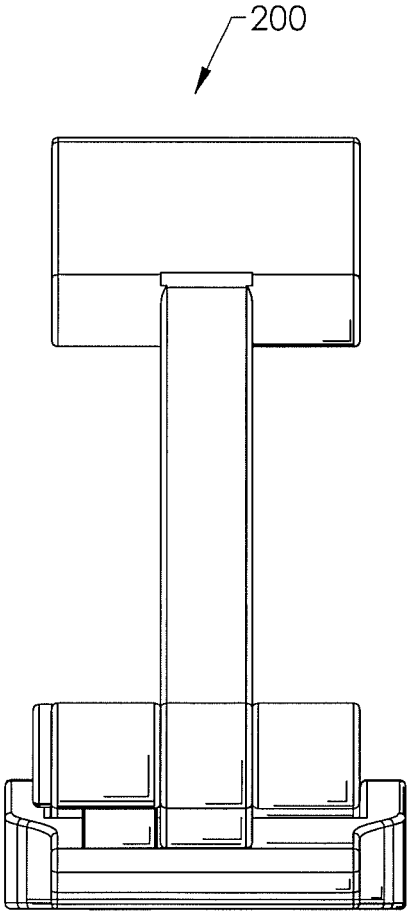
FIG. 24 is a rear view of the embodiment of FIGS. 19-23.
Figure 26:
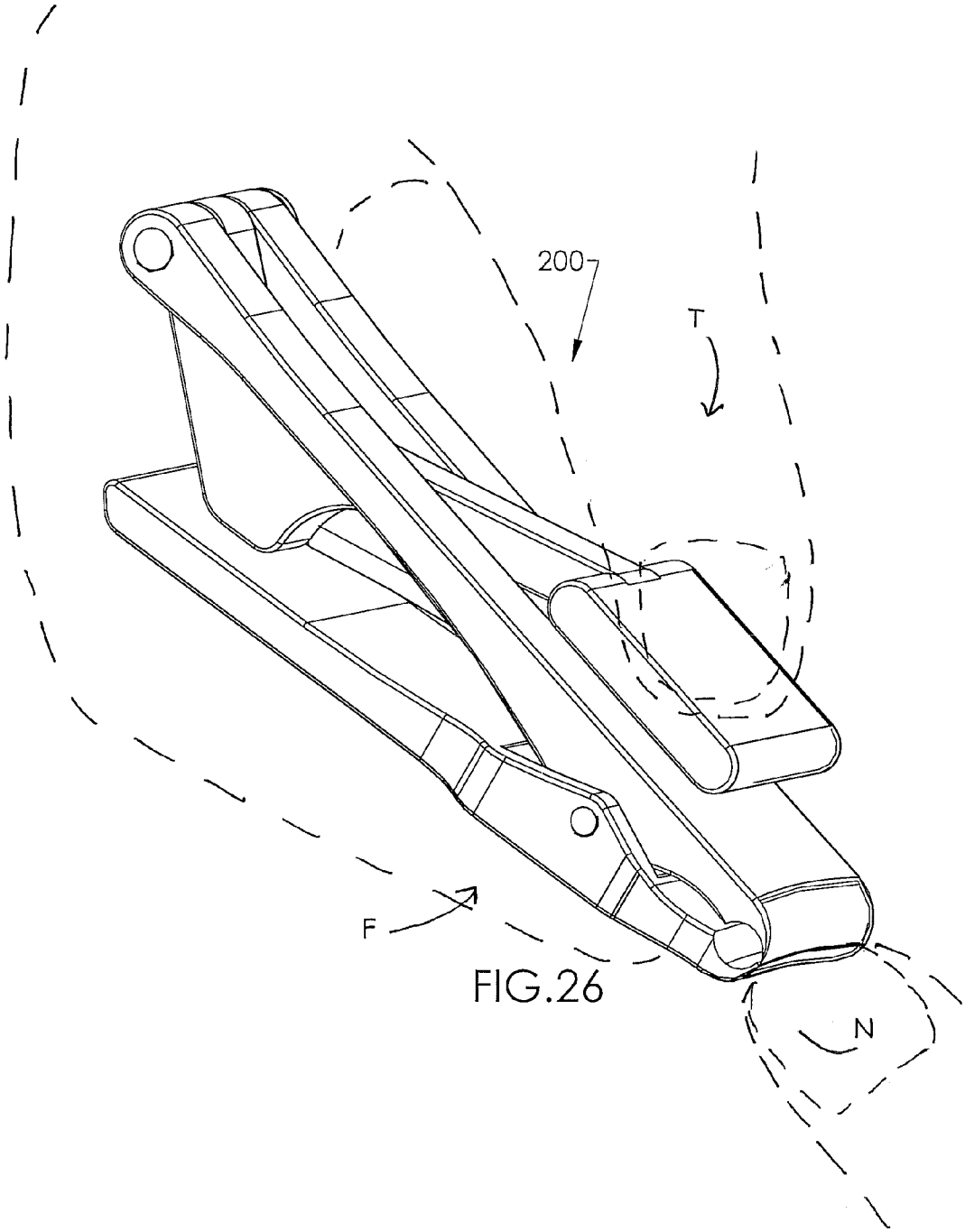
FIG. 26 is a right top perspective view of the embodiment of FIGS. 19-25 in the closed, cutting position.
Figure 27:
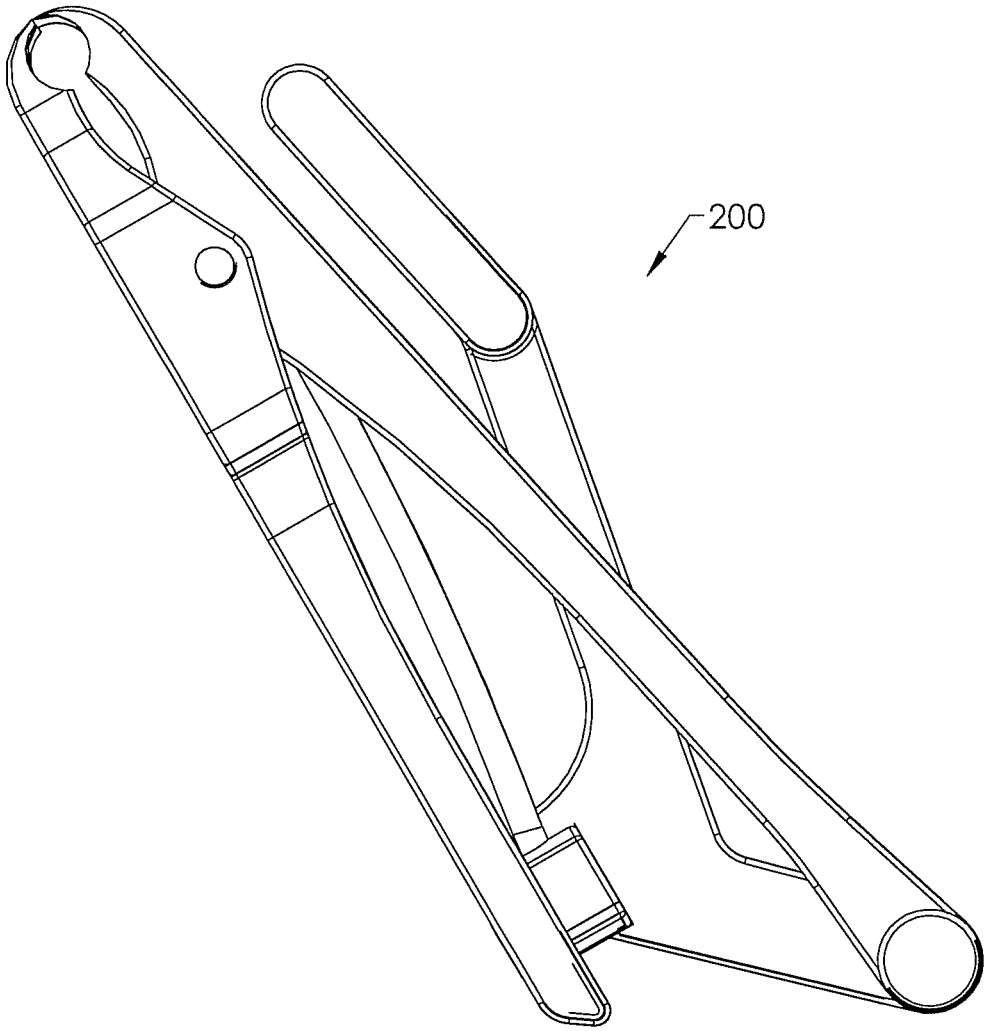
FIG. 27 is a left side view of the embodiment of FIGS. 19-26 in the closed, cutting position.

FIG. 19 and FIG. 20 are right and left views of nail trimmer 200, respectively, with the trimmer in the open, in-use position. FIG. 21 is a top view, FIG. 22 is a bottom view, FIG. 23 is a front view, and FIG. 24 is a back view of nail trimmer 10. FIG. 25 is a top, right-side perspective view of trimmer 200, with the clipper in open position, ready for use. FIGS. 26 and 27 are a top, right-side perspective view, and a left side view, respectively, of the trimmer 200 in closed, cutting position.

Figure 28:
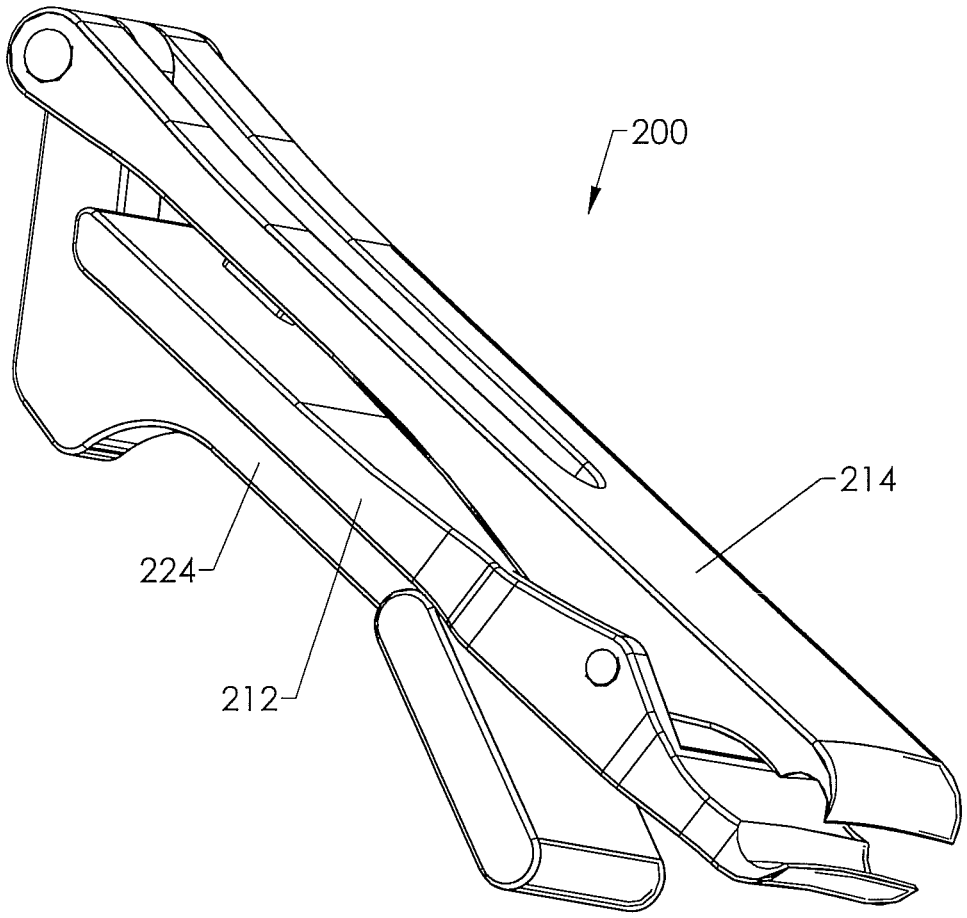
FIG. 28 is a right top perspective view of the embodiment of FIGS. 19-27, wherein the actuating lever has been swung rearward, down and around to be near the bottom surface of the trimmer, wherein the lever is preferably held there by a magnet, for storage.
Figure 29:
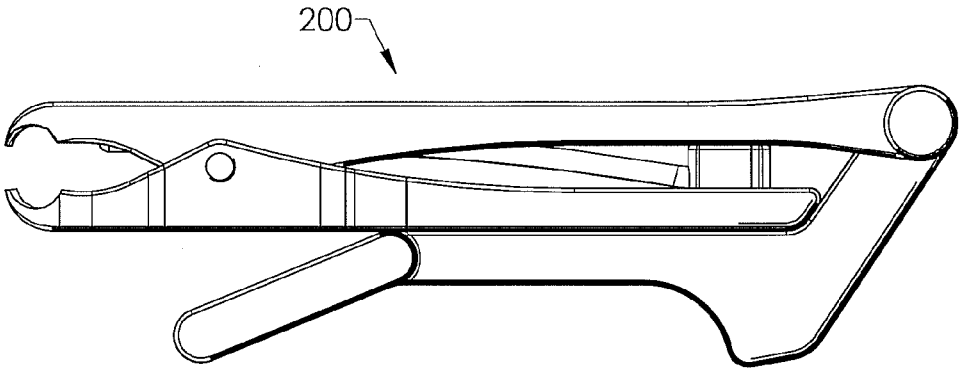
FIGS. 29 and 30 are left and right side views, respectively, of the embodiment of FIGS. 19-28, with the trimmer in the storage position as in FIG. 28.
Figure 30:
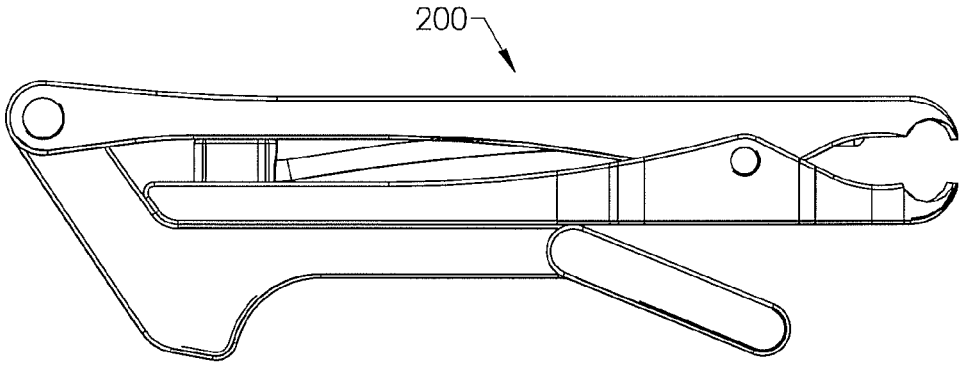

In FIG. 28, actuating lever 224 has been pushed back and rotated all the way around pivot axle 222 to reach and rest against the bottom surface of base plate 212. Preferably, lever 224 is maintained in this stored position by magnet 42 that is provided at or near the bottom surface of base plate 212. In this position, the trimmer 200 is compact and conveniently stored. FIGS. 29 and 30 depict a left and a right view, respectively, of the nail trimmer 200 in the storage configuration of FIG. 28.

Figure 31:
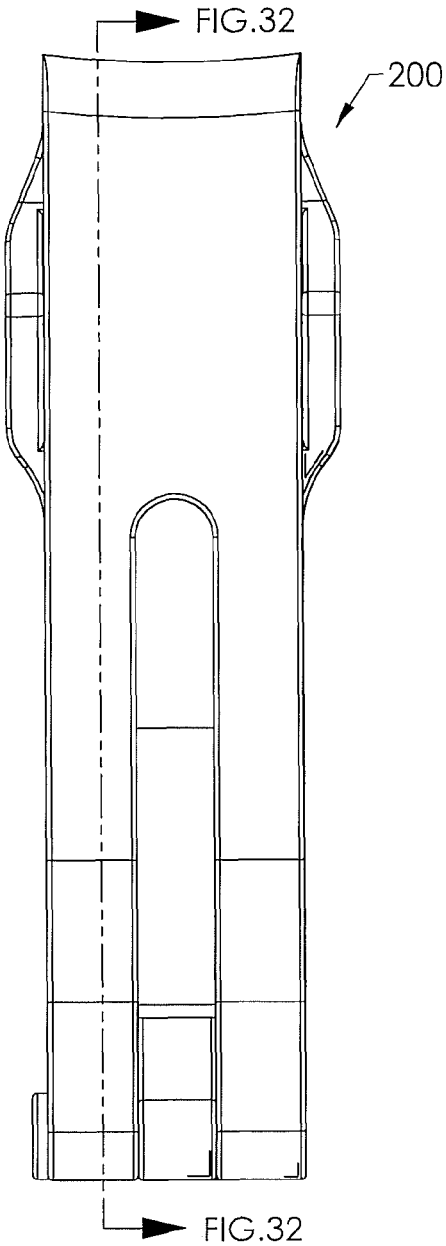
FIG. 31 is a top view of the embodiment of FIGS. 19-30, with the trimmer in the storage position as in FIGS. 28 and 29.
Figure 32:
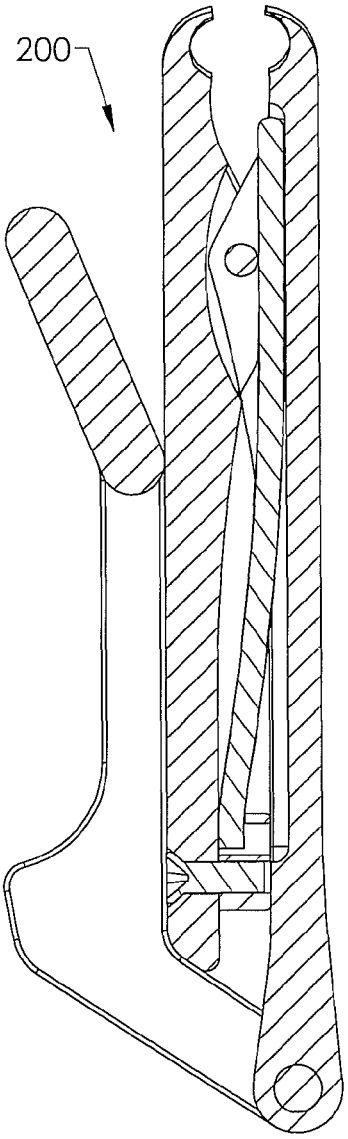
FIG. 32 is a cross-sectional view of the embodiment of FIGS. 19-31, with the trimmer in the storage position as in FIGS. 28-30, wherein the view is taken along the line 32-32 in FIG. 31.

FIG. 31 is a top view of the nail trimmer 200, in its storage configuration as in FIGS. 28-30. FIG. 31 has an off-center longitudinal section line 32-32, along which the cross-section of FIG. 32 is viewed. In FIG. 32, the screw that secures spring clamp 236 is visible. Other springs and/or spring-capture structure may be used to bias the front cutting edges apart until force is applied by a user to cut a nail; one of skill in the art will understand how to adapt the trimmer for said springs/capture structure after viewing and reading this document.

Figure 33:
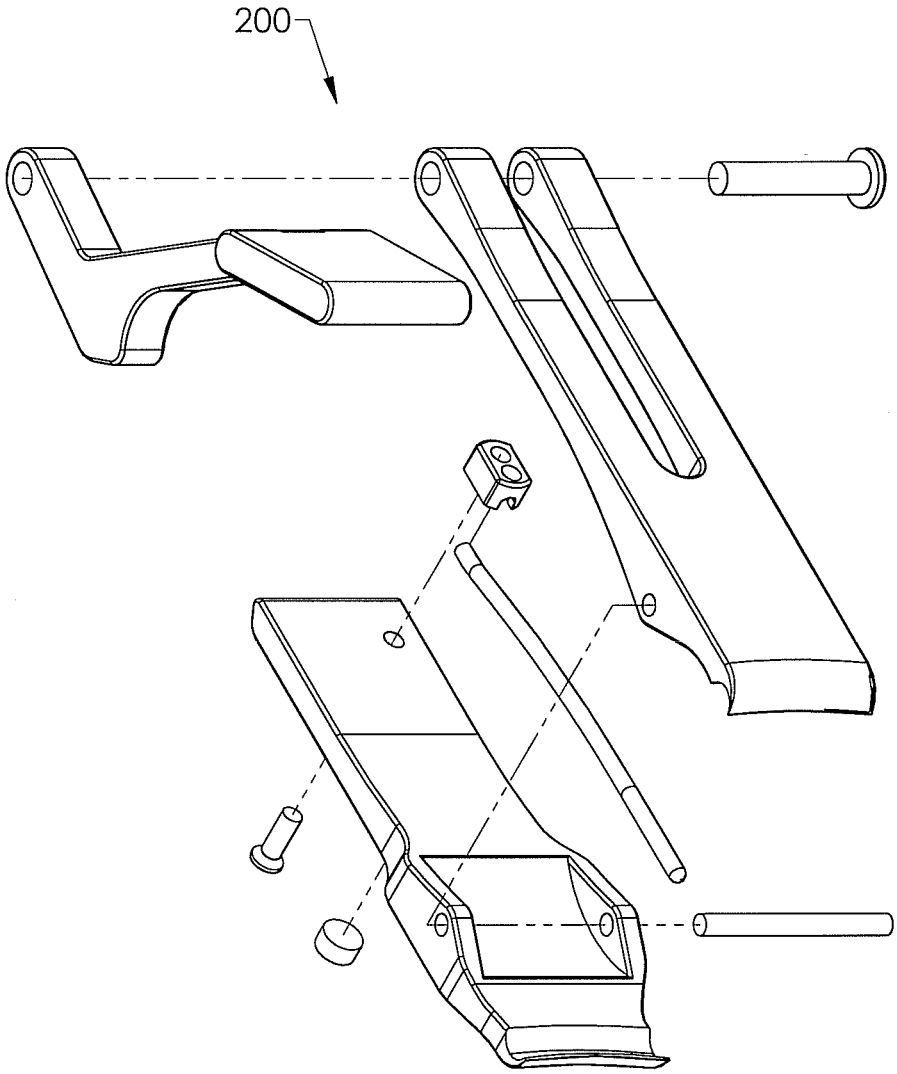
FIG. 33 is a right top exploded perspective view of the embodiment of FIGS. 19-31, with the trimmer in the in-use position with the lever swung above the top plate.

FIG. 33 is an exploded, perspective view of the embodiment depicted in FIGS. 19-32, wherein the lever 224 is in an in-use orientation rather than the storage orientation. While the pieces of the trimmer shown in FIG. 33 are not called-out with reference numbers, one may understand the pieces and their functions by referring to the description above and also to the description and call-out numbers for similar pieces in the portrayal of trimmer 10 in FIG. 15.

In use, the nail trimmers according to the invention tend to be more stable and accurate that convention nail trimmers. One may see in FIGS. 8 and 26 the typical use of the nail trimmers. Because the lever tip, when actuated, is at or near the front end of the trimmer, the user may position both thumb T and finger F at or near the front end of the trimmer. The trimmer is therefore held, and force is applied, between the thumb T and finger F near the cutting edges of the trimmer and near the nail N being cut, which results in stable and accurate performance. With a conventional trimmer, the thumb and finger(s) of the user are at or near the back end of the trimmer, for example, 1.5-3 inches away from the cutting edges. Consequently, with a conventional trimmer, the force of the thumb and finger required to close the cutting edges also frequently twists or turns the trimmer while the user is trying to trim the nail, and sometimes the trimmer even twists or flips away from the nail to be cut, and/or out of the hand of the user. Instead, in use of the invented trimmer, the thumb T and finger F, and the lever tip and the portion of bottom surface of the bottom plate that is contacted by the finger, are very close to the cutting edges, for example, 0-1 inch away. Therefore, with the invented trimmer, twists, turns, and flipping of the trimmer relative to the nail N are very unlikely to happen. One may note that the thumb and index finger are usually used to actuate the preferred nail trimmer, but other fingers may be used, especially because the stability of the trimmer makes the trimmer easier to use by older people and people with hand pain or problems.

The cammed lever of the preferred trimmers may contribute to smooth and efficient operation of the trimmer. One may see the operation cammed lever surfaces and operation of the cammed lever surfaces by comparing FIGS. 7 and 8, and FIGS. 17 and 18, for example. The cammed surfaces preferably comprise a protruding cam 23 that slides from a rear cam surface 25 to a bottom cam surface 26 during actuation of the trimmer (see call-out numbers in FIG. 1).

In many embodiments, the nail trimmer may be described as comprising: a bottom plate and a top plate pivotally connected at a central pivot point between the front end and rear ends of said plates, wherein the front end of each plate comprises a cutting edge; a spring captured between the top plate and bottom plate and biasing the front ends of the plates apart to an open position; a lever having a rear lever end pivotally connected to said top plate at a rear pivot point at or near the rear end of the top plate and the lever extending forward above said top plate, wherein the lever has a front tip for being pushed down toward the front end of the top plate, and wherein the lever has a cam protrusion near the rear lever end that slides along a top surface of the bottom plate to force the rear end of the bottom plate and the rear end of the top plate apart so that the cutting edges are moved together to cut a fingernail. The nail trimmer may comprise a longitudinal spring extending from near the front end of the plates to near the rear end of the plates. The longitudinal spring may be anchored to the top surface of the bottom plate near the rear end of the bottom plate, and extend forward above an axle of the central pivot point to abut at its front end up against the bottom surface of the top plate near the front end of the top plate. The central pivot point is preferably located at a position that is in a range of ⅙-⅓ of the distance from the front cutting edges to the rear pivot point. The rear pivot point is preferably rearward from the rear end of the bottom plate. The lever may be offset to a right side of said top plate, or offset to a left side of the top plate, or centrally located so that it is parallel to a central longitudinal axis of the nail trimmer. Said top plate may have a central space between right and left sides of the top plate so that the lever is pivotally connected to said to plate, and pivots in, said central space.

The cammed lever of the preferred trimmers may contribute to smooth and efficient operation of the trimmer. One may see the operation of the cammed lever surfaces by comparing FIGS. 7 and 8, and FIGS. 17 and 18, for example. The cammed surfaces preferably comprise a protruding cam 23 that slides from a rear cam surface 25 to a bottom cam surface 26 during actuation of the trimmer (sec call-out numbers in FIG. 1).

Although this invention has been described above with reference to particular means, materials and embodiments, it is to be understood that the invention is not limited to these disclosed particulars, but extends instead to all equivalents within the broad scope of the following claims.

The invention claimed is:

1. A nail trimmer adapted to be in an open position, an actuated position for cutting a nail, and a storage position, the nail trimmer comprising:

a bottom plate and a top plate pivotally connected at a central pivot point between the front ends and rear ends of said plates, wherein the front end of each plate comprises a cutting edge;

a spring captured between the top plate and bottom plate and biasing the front ends of the plates apart to the open position;

a lever having an elongated rear portion having a longitudinal axis, an elongated front tip portion having a longitudinal axis, and an elongated middle portion having a longitudinal axis and being between said rear portion and said front tip portion and connected to the rear portion at a junction, wherein the middle portion longitudinal axis is at an obtuse angle to the rear portion longitudinal axis;

wherein said rear portion has a rear lever end pivotally connected to said top plate at a rear pivot point that is at or near the rear end of the top plate and that is rearward from the rear end of the bottom plate, and, wherein, in the open position, the rear portion extends forward beside the top plate so that the rear portion longitudinal axis is generally parallel to the top plate, and the middle portion and front tip portion extend upward and forward above said top plate, and wherein the lever further has a cam protrusion on a bottom side of the lever near said junction, wherein, when said front tip portion is pushed toward the top plate, the lever pivots in a first direction and the cam protrusion contacts and cooperates with a top surface of the bottom plate to force the rear end of the bottom plate and the rear end of the top plate apart so that the cutting edges are moved together into the actuated position to cut said nail; and wherein the lever pivots in a direction opposite to said first direction to enter the storage position wherein the rear portion extends downward from said rear pivot point and behind the rear end of the bottom plate, the middle portion is below, parallel to, and against a bottom surface of the bottom plate, and the front tip portion is below and adjacent to the bottom surface of the bottom plate.

2. The nail trimmer as in claim 1, wherein the spring is a longitudinal spring extending from near the front end of the plates to near the rear end of the plates.

3. The nail trimmer as in claim 1, wherein the longitudinal spring is anchored to a top surface of the bottom plate near the rear end of the bottom plate, and extends forward above an axle of the central pivot point, so that the front end of the spring abuts up against a bottom surface of the top plate near the front end of the top plate.

4. The nail trimmer as in claim 1, wherein the central pivot point is located at a position that is in a range of ⅙-⅓ of the distance from the front cutting edges to the rear pivot point.

5. The nail trimmer as in claim 1, wherein the lever is offset to a right side of said top plate.

6. The nail trimmer as in claim 1, wherein the lever is offset to a left side of the said top plate.

7. The nail trimmer as in claim 1, wherein said top plate has a central space between the right and left sides of the top plate and said lever is pivotally connected to said top plate, and pivots in said central space.

8. The nail trimmer as in claim 1, wherein the bottom surface of the bottom plate has a magnet, and said lever is held in said storage position by said magnet attracting the lever.

9. The nail trimmer as in claim 8, wherein said front tip portion longitudinal axis is at an obtuse angle to the middle portion longitudinal axis.

10. The nail trimmer as in claim 1, wherein, when the lever is actuated to force the cutting edges of the top and bottom plates together, the lever front tip front-most end is forward of said central pivot point.

11. A nail trimmer adapted to be in an open position, an actuated position for cutting a nail, and a storage position, the nail trimmer consisting essentially of:

a bottom plate and a top plate pivotally connected at a central pivot point between the front ends and rear ends of said plates, wherein the front end of each plate comprises a cutting edge;

a spring captured between the top plate and bottom plate and biasing the front ends of the plates apart to the open position;

a lever having an elongated rear portion having a longitudinal axis, an elongated front tip portion having a longitudinal axis, and an elongated middle portion having a longitudinal axis and being between said rear portion and said front tip portion and connected to the rear portion at a junction, wherein the middle portion longitudinal axis is at an obtuse angle to the rear portion longitudinal axis;

wherein said rear portion has a rear lever end pivotally connected to said top plate at a rear pivot point that is at or near the rear end of the top plate and that is rearward from the rear end of the bottom plate, and, wherein, in the open position, the rear portion extends forward beside the top plate so that the rear portion longitudinal axis is generally parallel to the top plate, and the middle portion and front tip portion extend upward and forward above said top plate; and wherein the lever further has a cam protrusion on a bottom side of the lever near said junction, wherein, when said front tip portion is pushed toward the top plate, the lever pivots in a first direction and the cam protrusion contacts and cooperates with a top surface of the bottom plate to force the rear end of the bottom plate and the rear end of the top plate apart so that the cutting edges are moved together into the actuated position to cut said nail; and wherein the lever pivots in a direction opposite to said first direction to enter the storage position wherein the rear portion extends downward from said rear pivot point and behind the rear end of the bottom plate, the middle portion is below, parallel to, and against a bottom surface of the bottom plate, and the front tip portion is below and adjacent to the bottom surface of the bottom plate; and wherein the nail trimmer comprises a magnet to hold the lever in the storage position.

12. The nail trimmer as in claim 11, wherein the lever is offset to a right side of said top plate.

13. The nail trimmer as in claim 11, wherein the lever is offset to a left side of the said top plate.

14. The nail trimmer as in claim 11, wherein said top plate has a central space between the right and left sides of the top plate and said lever pivots in said central space.

15. The nail trimmer as in claim 11, wherein the front tip portion longitudinal axis is at an obtuse angle to the middle portion longitudinal axis.

16. A nail trimmer adapted to be in an open position, an actuated position for cutting a nail, and a storage position, the nail trimmer comprising:

a bottom plate and a top plate pivotally connected at a central pivot point between the front ends and rear ends of said plates, wherein the front end of each plate comprises a cutting edge;

a spring captured between the top plate and bottom plate and biasing the front ends of the plates apart to the open position;

a lever having an elongated rear portion having a longitudinal axis, an elongated front tip portion having a longitudinal axis, and an elongated middle portion having a longitudinal axis and being between said rear portion and said front tip portion and connected to the rear portion at a junction, wherein the middle portion longitudinal axis is at an obtuse angle to the rear portion longitudinal axis;

wherein said rear portion has a rear lever end pivotally connected to said top plate at a rear pivot point that is at or near the rear end of the top plate and that is rearward from the rear end of the bottom plate, and, wherein, in the open position, the rear portion extends forward beside the top plate so that the rear portion longitudinal axis is generally parallel to the top plate, and the middle portion and front tip portion extend upward and forward above said top plate; and wherein the lever further has a cam protrusion on a bottom side of the lever near said junction, the cam protrusion having a lower surface comprising a rearward corner, a forward corner, and a planar surface between said rearward and forward corners, and wherein, when said front tip portion is pushed toward the top plate, the lever pivots in a first direction and the lower surface of the cam protrusion contacts and cooperates with a top surface of the bottom plate to force the rear end of the bottom plate and the rear end of the top plate apart so that the cutting edges are moved together into the actuated position to cut said nail; and wherein the lever pivots in a direction opposite to said first direction to enter the storage position wherein the rear portion extends downward from said rear pivot point and behind the rear end of the bottom plate, the middle portion is below, parallel to, and against a bottom surface of the bottom plate, and the front tip portion is below and adjacent to the bottom surface of the bottom plate.

17. The nail trimmer as in claim 16, wherein the lever is offset to a right side of said top plate.

18. The nail trimmer as in claim 16, wherein the lever is offset to a left side of the said top plate.

19. The nail trimmer as in claim 16, wherein said top plate has a central space between the right and left sides of the top plate and said lever pivots in said central space.

20. The nail trimmer as in claim 16, wherein the front tip portion longitudinal axis is at an obtuse angle to the middle portion longitudinal axis.

21. The nail trimmer as in claim 16, wherein said rearward corner is a first distance from said rear pivot point, and said forward corner is a second distance from said rear pivot point, wherein said second distance is greater than said first distance.

* * * * *